US010292212B2

(12) United States Patent
Hall et al.

(10) Patent No.: US 10,292,212 B2
(45) Date of Patent: May 14, 2019

(54) DOUBLE-CAVITY MICROWAVE OVEN

(71) Applicants: David R. Hall, Provo, UT (US); Andrew Priddis, Mapleton, UT (US); Matthew Liddle, Orem, UT (US); Jedediah Knight, Provo, UT (US)

(72) Inventors: David R. Hall, Provo, UT (US); Andrew Priddis, Mapleton, UT (US); Matthew Liddle, Orem, UT (US); Jedediah Knight, Provo, UT (US)

(73) Assignee: Hall Labs LLC, Provo, UT (US)

( * ) Notice: Subject to any disclaimer, the term of this patent is extended or adjusted under 35 U.S.C. 154(b) by 393 days.

(21) Appl. No.: 15/364,546

(22) Filed: Nov. 30, 2016

(65) Prior Publication Data

US 2018/0152991 A1 May 31, 2018

(51) Int. Cl.

| | |
|---|---|
| ***H05B 6/64*** | (2006.01) |
| ***H05B 6/68*** | (2006.01) |
| ***H05B 6/72*** | (2006.01) |
| ***F24C 7/02*** | (2006.01) |

(52) U.S. Cl.

CPC ..... *H05B 6/6402* (2013.01); *H05B 6/6417* (2013.01); *H05B 6/6444* (2013.01); *H05B 2206/044* (2013.01)

(58) Field of Classification Search

CPC .. H05B 6/6402; H05B 6/6417; H05B 6/6444; H05B 2206/044

USPC ..... 219/697, 678, 702, 745, 747, 748, 749, 219/750, 751, 756, 761, 763

See application file for complete search history.

(56) References Cited

U.S. PATENT DOCUMENTS

| | | | | |
|---|---|---|---|---|
| 7,087,872 B1 * | 8/2006 | Dobie | F24C 15/166 | 219/401 |
| 2008/0087662 A1 * | 4/2008 | Takizaki | H05B 6/6402 | 219/678 |
| 2013/0153570 A1 * | 6/2013 | Carlsson | H05B 6/80 | 219/702 |

* cited by examiner

*Primary Examiner* — Quang T Van

(57) ABSTRACT

A double-cavity microwave oven is disclosed that includes a first and a second cooking cavity, a moveable barrier disposed between the first and the second cavity, a first and a second magnetron, and a first and a second waveguide corresponding to the first and the second magnetron, respectively. The first cavity is electromagnetically isolated from the second cavity, and, as the barrier moves, the size of the first cavity relative to the second cavity changes. As the barrier is in a first position, the first waveguide directs microwaves from the first magnetron to the first cavity and the second waveguide directs microwaves from the second magnetron to the second cavity. As the barrier is in a second position, the first and the second waveguide direct microwaves from the first and the second magnetron to the first cavity. Various embodiments are also disclosed including additional features.

20 Claims, 22 Drawing Sheets

DOUBLE-CAVITY MICROWAVE OVEN

TECHNICAL FIELD

This invention relates generally to the field of microwave ovens.

BACKGROUND

The modern microwave oven, for all it's apparent sophistication, has stagnated in technological progress over the past decade. The need for improvement is no more necessary than in cooking thoroughness, uniformity, and in oven capacity. Current solutions are severely limited. For example, the best solution for uniform cooking that has been developed so far is to rotate a plate supporting the object to be heated in the oven. However, this only captures variability of constructive interference of microwaves in two dimensions. Additionally, microwave oven capacity has technical and practical limitations that need to be overcome before design options can become more robust. Modern home design is moving towards lean and minimalistic features, while still providing all the modern conveniences, including microwave ovens. However, current ovens are not compatible with many new designs because of shape and power requirements, among other reasons. Thus, there is significant room for improvement to current microwave design and functional aspects.

SUMMARY OF THE INVENTION

A double-cavity microwave oven is described herein that addresses some of the problems in the art described above. In general, the microwave oven includes two cavities, two corresponding magnetrons and waveguides, and a moveable barrier disposed between the two cavities. The disclosed microwave oven provides several benefits over other microwave ovens. First, this microwave oven provides flexible cavity size to accommodate either personal-sized meals or larger food items. Second, the disclosed microwave oven offers flexible power consumption compared with other microwave ovens. Having two magnetrons, this microwave oven can cook with one magnetron or alternate power between the two magnetrons in cooking two meals simultaneously. For large meals, power is provided to both magnetrons simultaneously. One benefit of this arrangement is that a lower supply power provides higher cooking power and flexibility.

In one embodiment of the claimed invention, a double-cavity microwave oven is disclosed that includes a first and a second cooking cavity, a moveable barrier disposed between the first and the second cavity, a first and a second magnetron, and a first and a second waveguide corresponding to the first and the second magnetron, respectively. The first cavity is electromagnetically isolated from the second cavity, and, as the barrier moves, the size of the first cavity relative to the second cavity changes. As the barrier is in a first position, the first waveguide directs microwaves from the first magnetron to the first cavity and the second waveguide directs microwaves from the second magnetron to the second cavity. As the barrier is in a second position, the first and the second waveguide direct microwaves from the first and the second magnetron to the first cavity. Various other embodiments are also disclosed including additional features.

BRIEF DESCRIPTION OF THE DRAWINGS

A more particular description of the invention briefly described above is made below by reference to specific embodiments. Several embodiments are depicted in drawings included with this application, in which:

FIGS. 1-4D depict various aspects of a modern building having unique construction aspects that necessitate the improvements to the microwave oven described herein;

FIG. 2 depicts a building infrastructure;

FIG. 3 depicts an exploded view of a building infrastructure;

FIGS. 4A-D depict perspective views of different embodiments of prismatic box-like structures;

DETAILED DESCRIPTION

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

The descriptions of the various embodiments include, in some cases, references to elements described with regard to other embodiments. Such references are provided for convenience to the reader, and to provide efficient description and enablement of each embodiment, and are not intended to limit the elements incorporated from other embodiments to only the features described with regard to the other embodiments. Rather, each embodiment is distinct from each other embodiment. Despite this, the described embodiments do not form an exhaustive list of all potential embodiments of the claimed invention; various combinations of the described embodiments are also envisioned, and are inherent from the descriptions of the embodiments below. Additionally, embodiments not described below that meet the limitations of the claimed invention are also envisioned, as is recognized by those of skill in the art.

Throughout the detailed description, various elements are described as "off-the-shelf" or otherwise commonly known or used in the art. As used herein, descriptions mean "pre-manufactured" and/or "pre-assembled."

In some instances, features represented by numerical values, such as dimensions, quantities, and other properties that can be represented numerically, are stated as approximations. Unless otherwise stated, an approximate value means "correct to within 50% of the stated value." Thus, a length of approximately 1 inch should be read "1 inch +/−0.5 inch." Similarly, other values not presented as approximations have tolerances around the stated values understood by those skilled in the art. For example, a range of 1-10 should be read "1 to 10 with standard tolerances below 1 and above 10 known and/or understood in the art."

Figure 1:
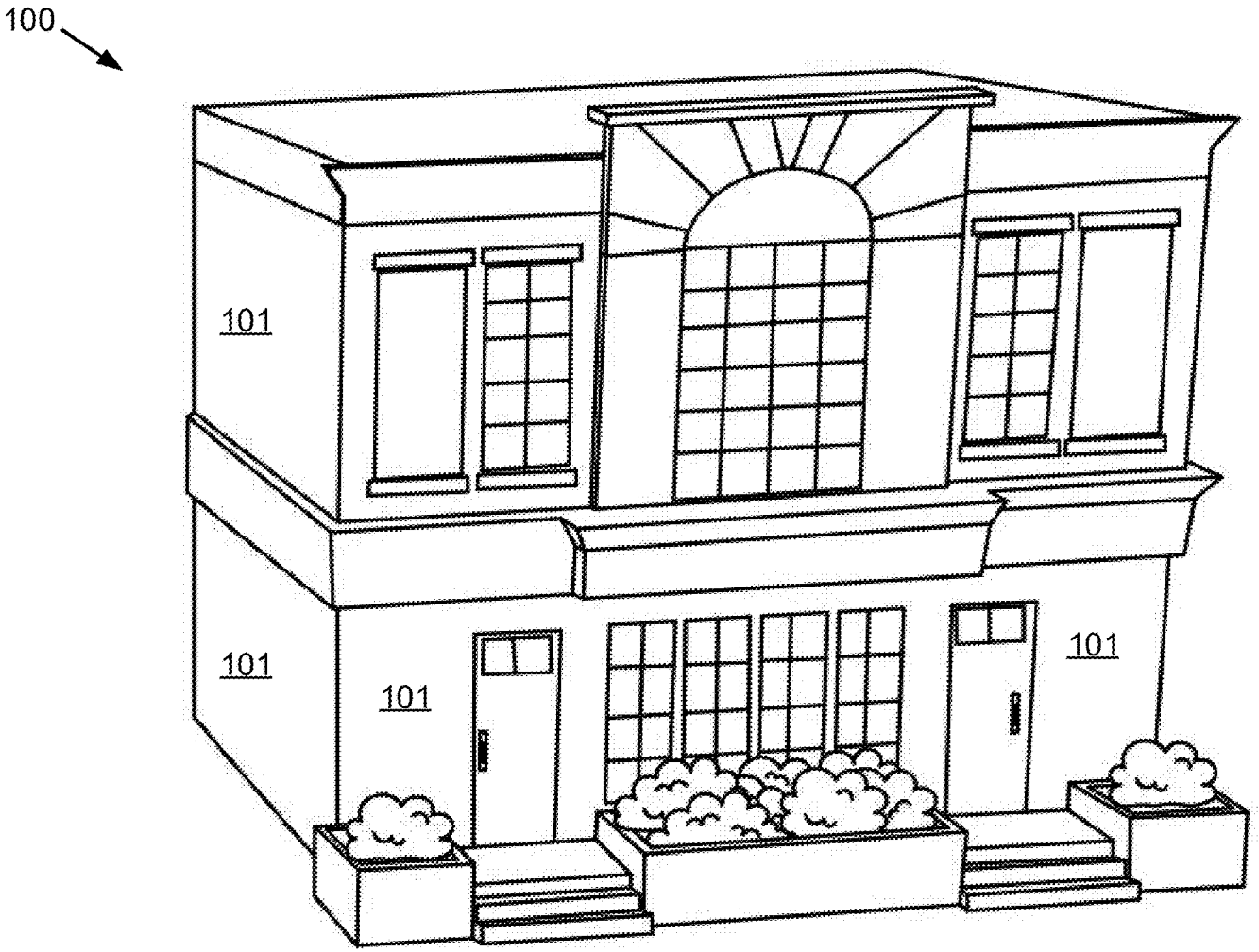

FIGS. 1-4D depict various aspects of a modern building having unique construction aspects that necessitate the microwave oven improvements described herein. FIG. 1 depicts a perspective view of one embodiment of such a building, structure 100. As shown, the outer finish of structure 100 is, in some embodiments, a facade with any variety of architectural embellishments. Inside outer walls 101, though unseen, is a building infrastructure comprising a plurality of conjoining modular building segments. Building 100 is similar to that described in U.S. patent application Ser. No. 15/157,742 by David R. Hall, et. al., for "Modular Prismatic Box-Like Structure-Based Building Method and Infrastructure," which is incorporated herein in its entirety by reference.

Figure 2:
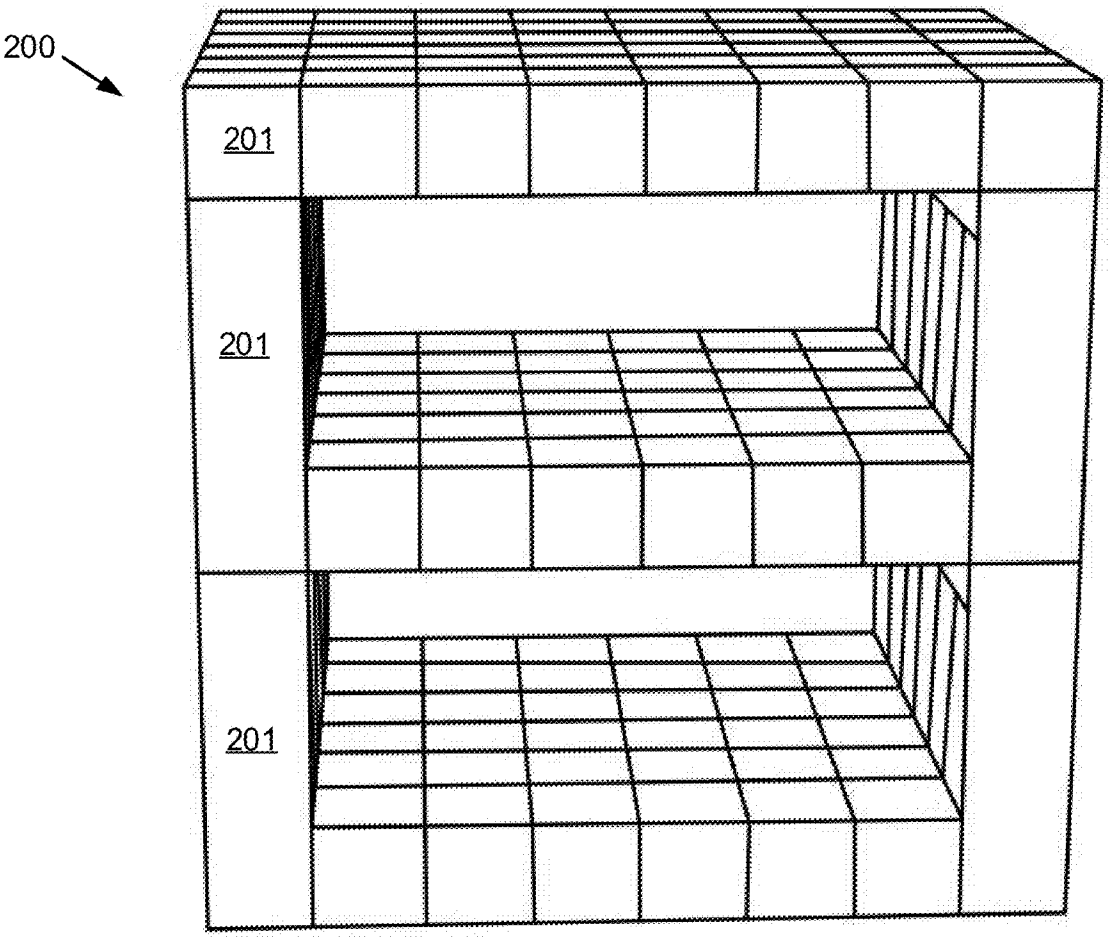

FIG. 2 depicts building infrastructure 200, which comprises a plurality of conjoining modular building segments 201. As shown, the plurality of conjoining modular building segments are prismatic, box-like structures.

Figure 3:
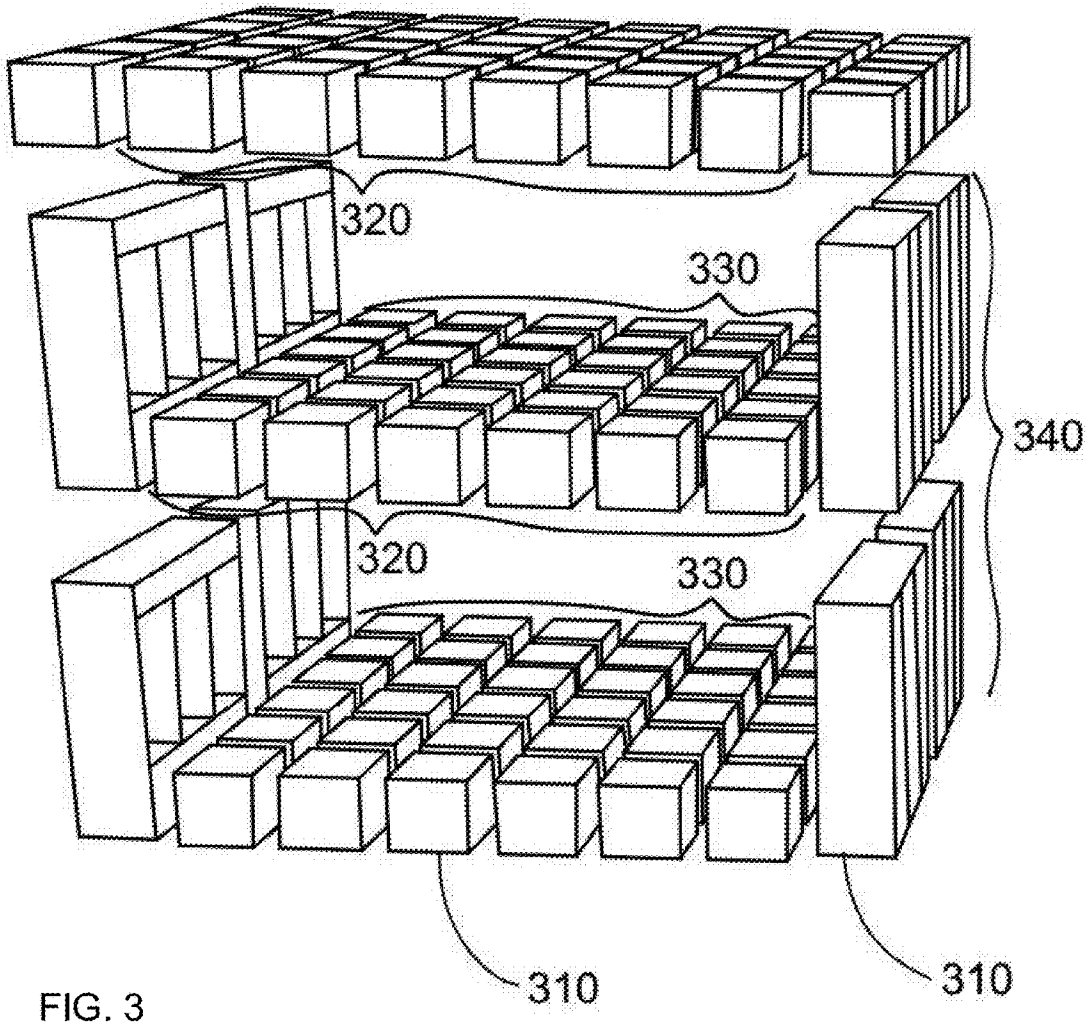

FIG. 3 depicts an exploded view of a building infrastructure, similar to that depicted in FIG. 2, such that each individual prismatic box-like structure is visible. Building infrastructure 300 includes prismatic structures 310; a first selection 320 of the plurality of prismatic box-like structures, placed side by side horizontally and mechanically attached to form a length and width of at least one ceiling; a second selection 330 of the plurality of conjoining modular building segments are placed side by side horizontally and mechanically attached to form a length and width of at least one floor; and a third selection 340 of the plurality of conjoining modular building segments are placed side by side vertically and mechanically attached to each other and to at least one ceiling and at least one floor to form a plurality of walls for the building infrastructure.

FIGS. 4A-D depict perspective views of different embodiments of the prismatic box-like structures. The prismatic box-like structures may comprise different shapes, including shapes like cubic 4A, rectangular 4B, triangular 4C, and hexagonal 4D. Each prismatic box-like structure comprises at least three walls 400. Each prismatic box-like structure comprises an apparatus suitable for disposition of a stored item. A space 410 inside the walls measures at least one cubic foot in order that items can be stored within the prismatic box-like structures, thus maximizing space, efficiency, sustainability, and structural integrity of the building infrastructure.

Figure 4D:
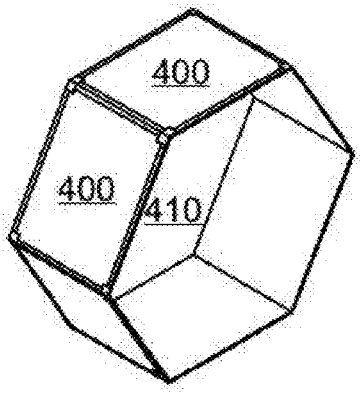
Figure 4A:
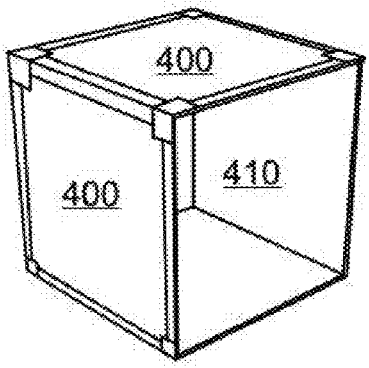
Figure 4C:
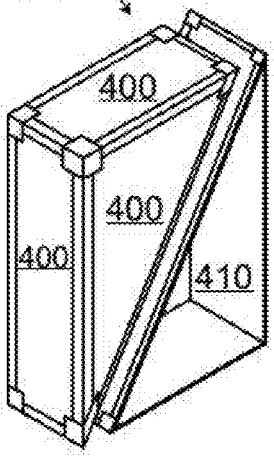
Figure 4B:
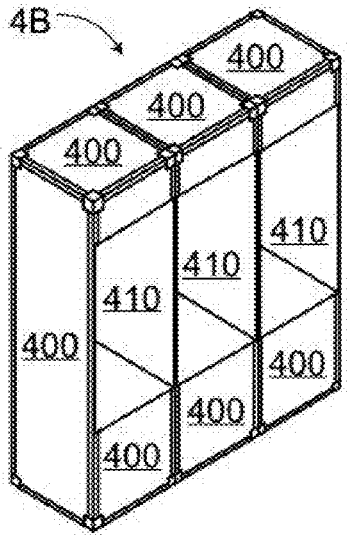

FIG. 4B depicts one unique structural arrangement in which the microwave oven of the claimed invention is, in various embodiments, particularly useful. As described above, the size of the prismatic structures is particularly chosen for efficiency, structural integrity. Power provisioning is likewise chosen to maximize these characteristics. Many current appliances, while individually compatible with the described infrastructure, are not collectively compatible, such as because of size and power requirements, among other reasons. Thus, new appliance designs are needed. The claimed microwave oven is one such appliance compatible with the unique building infrastructure described above.

In general, microwave ovens are subject to certain power and dimension limitations in order to function properly. Microwave frequencies range from 300 MHz to 300 GHz, but the most common frequency used in consumer microwave ovens is 2.45 GHz, which has a wavelength of approximately 12.2 cm. In commercial microwave ovens, the most common frequency is 915 MHz, which has a wavelength of 32.8 cm. This limits the size of microwaves to having at least two dimensions having lengths equal to a half-wavelength multiple to allow for resonance. Common power ratings range from 700 W to 1800 W, depending on the space available for a transformer and the power source the microwave oven is plugged in to. For example, countertop microwave ovens are configured to be powered through a typical 110-V outlet, whereas some built-in and/or commercial microwave ovens are configured to be powered through a typical 220-V outlet.

While every variety of size and/or power is theoretically available by simply varying the frequency or power output, practical limitations, such as the commercial availability of transformers and magnetrons at desired frequencies, limits economical construction of microwave ovens outside of those commonly constructed. It is thus one object of the microwave oven disclosed herein to provide for flexibility within the current economical restraints. FIGS. 5-16 depict various embodiments of such a microwave oven. In general, a double-cavity microwave oven is described that includes a first and a second cooking cavity, a moveable barrier disposed between the first and the second cavity, a first and a second magnetron, and a first and a second waveguide corresponding to the first and the second magnetron, respectively. The first cavity is electromagnetically isolated from the second cavity, and, as the barrier moves, the size of the first cavity relative to the second cavity changes. As the barrier is in a first position, the first waveguide directs microwaves from the first magnetron to the first cavity and the second waveguide directs microwaves from the second magnetron to the second cavity. As the barrier is in a second position, the first and the second waveguide direct microwaves from the first and the second magnetron to the first cavity.

In some embodiments, the microwave oven includes a single door that provides access by a user to the first and the second cooking cavity. Further embodiments of the single door include those wherein the door thermally and/or electromagnetically segregates the first cavity from the second cavity. In other embodiments, the microwave oven includes a first door corresponding to the first cavity, and a second door corresponding to the second cavity. The first door is adjacent to the second door and the first and the second door each form an electromagnetic seal with the barrier. In various further embodiments of the double-door embodiment, the first door is disposed above the second door, and the first and the second door open in the same direction, or the first door opens upwards and the second door opens down; or the first and the second door are side-by-side and open in the same direction, or away from each other such that the first door opens to the left and the second door opens to the right. Additionally, in some dual-door embodiments, the first or the second door locks and becomes non-operable as the barrier is in the second position.

In various embodiments, the barrier incorporates a variety of beneficial features. For example, in some embodiments, the barrier thermally segregates the first cavity from the second cavity. In some embodiments, the barrier is moveable in a first direction, such as to expand one cavity and contract the other, and is fixed in a second direction perpendicular to the first directions such that the barrier is non-removeable from the microwave oven. Some embodiments of the barrier include one or more lights and microwave shielding between the lights and the first magnetron, the second magnetron, or both. The shielding is at least partially transparent to visible light, but at least mostly opaque to microwaves. In some embodiments wherein the barrier includes the lights, the barrier includes a first light facing the first cavity and a second light facing the second cavity. Another feature included in some embodiments is motorization of the barrier such that an electric motor and a transmission move the barrier between the first and the second positions.

One difficulty with heating an object in a microwave oven is achieving uniform heating throughout the object. One benefit of the claimed invention is that more even heating is achieved through three-dimensional motion, either of the object being heated, the cavity, or the microwave source. For example, in some embodiments, at least one of the first or the second cavity oscillates relative to at least one of the first or the second waveguide such that a first path length from the at least one waveguide to a first wall of the at least one cavity and a second path length from the at least one waveguide to a second wall of the at least one cavity varies with the oscillation. This causes the zones of constructive interference in the microwave to move because the path length of waves being emitted from the microwave source varies. In some such embodiments, a stationary support plate is disposed in the at least one cavity such that a third path length from the at least one waveguide to the support surface is constant with the oscillation. Alternatively, in some embodiments, the support plate oscillates along three dimensional axes such that a first path length from the first waveguide, the second waveguide, or both, to the support plate varies with the oscillation. In some embodiments, at least one of the first or the second waveguide oscillates relative to at least one of the first or the second cavity such that a first path length from the at least one waveguide to a first wall of the at least one cavity and a second path length from the at least one waveguide to a second wall of the at least one cavity varies with the oscillation. And, in some embodiments, at least one of the first and the second cavities comprises at least one flexible wall that oscillates such that a first path length from the first waveguide, the second waveguide, or both, to the flexible wall varies with the oscillation.

Various means for controlling the magnetrons are available. For example, in one embodiment, the microwave oven includes a single controller for both magnetrons. The controller includes one or more hardware processors and hardware memory. The hardware memory stores instructions that, when executed by the hardware processors, operate the first magnetron, the second magnetron, or both. In some such embodiments, operating the first and the second magnetron comprises oscillating power delivery from a single power input between the first and the second magnetron. Additionally, in some such embodiments, the processors are coupled to one user input device for both cavities. The processors know which magnetron to power based on which door was opened or a reflectance pattern of microwaves generated by the first magnetron, the second magnetron, or both. For example, one embodiment includes one or more microwave-sensitive diodes exposed to the first cavity, the second cavity, or both, either together or separately. The diodes are also electrically coupled to the processors. The memory stores a current generated by the diodes when the microwave operates and the cavities are empty. When an object is placed in one of the cavities to be heated, that object absorbs some of the microwaves in the cavity, reducing the amount of reflectance observed by the diodes, and thus reducing the current generated by the diodes. The controller knows, based on the current generated by the diodes, whether a cavity is being used, and even how large and/or dense the object in the microwave is. A method for determining whether an object is in a cavity, and thus whether or not the microwaves should be sent to that cavity, includes sending a microwave pulse into the cavity and detecting, by the diodes, the level of reflectance of the pulse. The method further includes determining, based on the reflectance, whether an object is in the cavity. If an object is in the cavity, microwaves are directed to the cavity to heat the object. If an object is not present, no microwaves are sent.

The figures described below disclose the microwave oven described above, including the various embodiments, in enough detail to enable one of skill in the art of microwave ovens to make and/or use the microwave oven claimed herein.

Figure 5A:
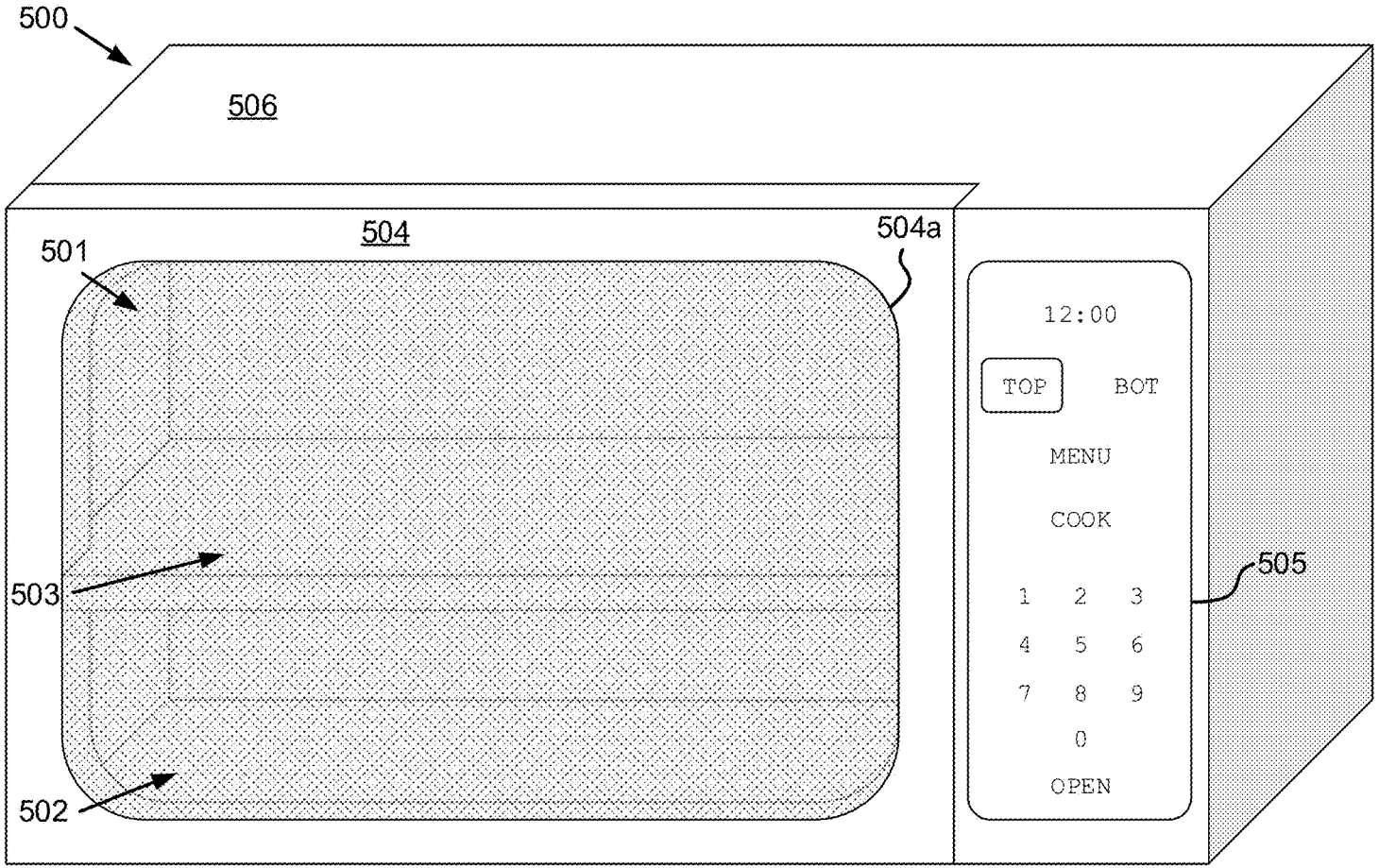
FIGS. 5A-B depict one embodiment of a microwave oven according to the claimed invention.
Figure 5B:
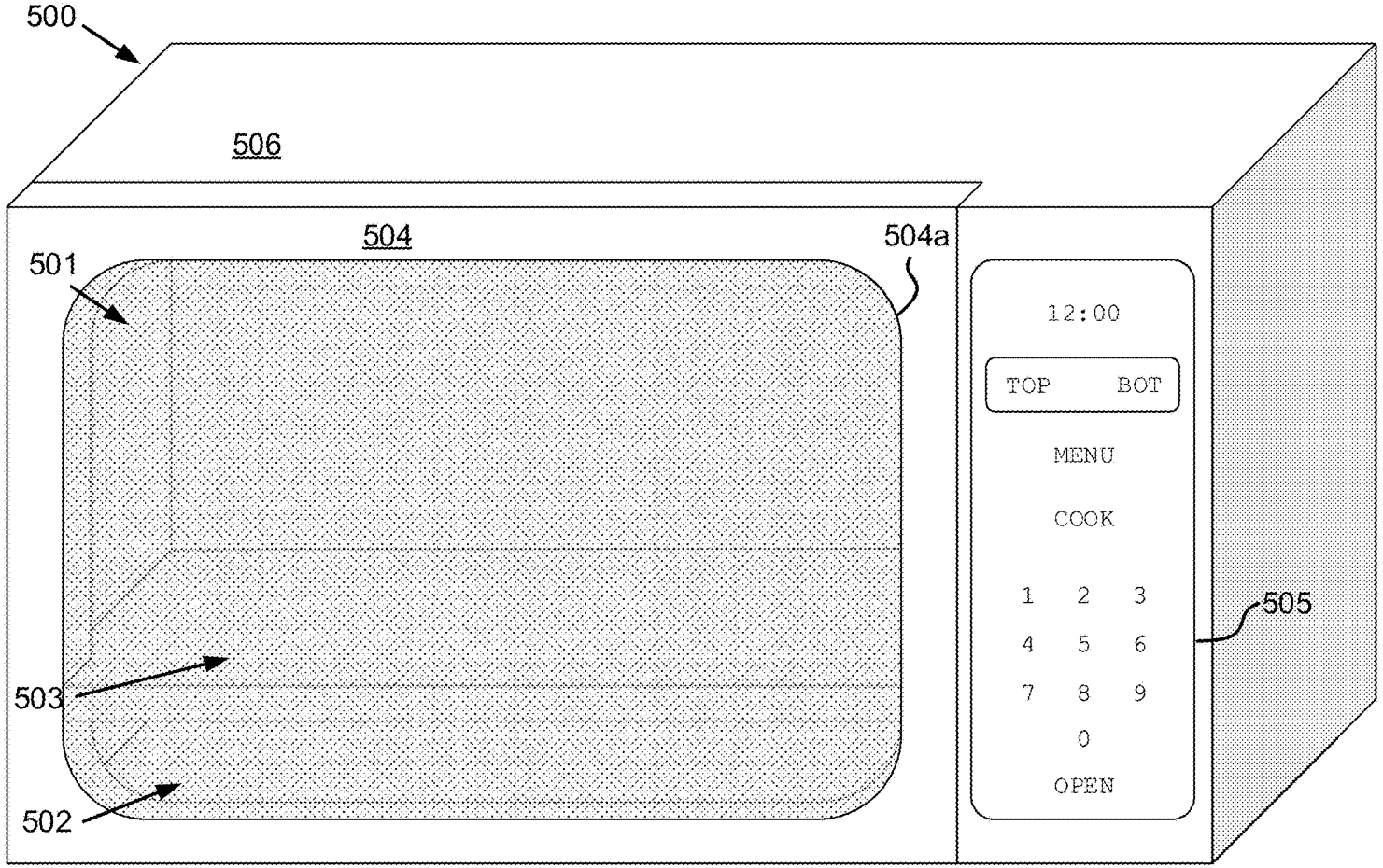

FIGS. 5A-B depict one embodiment of a microwave oven according to the claimed invention. Microwave oven 500 includes first cavity 501, second cavity 502, barrier 503, door 504, control panel 505, and housing 506. As shown in FIG. 5A, barrier 503 is in a first position where first cavity 501 and second cavity 502 are approximately the same size. As shown in FIG. 5B, barrier 503 is in a second position where first cavity 501 is larger than second cavity 502. In the first position, microwaves from a first magnetron (not shown, but similar to that depicted in FIGS. 9A-B, for example) are directed by a first waveguide to first cavity 501, and microwaves from a second magnetron (also not shown, but similar to that depicted in FIGS. 9A-B, for example) are directed by a second waveguide to second cavity 502. However, in the second position, microwaves from the first and the second magnetron are directed towards first cavity 501.

First cavity 501 and second cavity 502 are constructed similar to other microwave oven cavities typical in the industry. Thus, the walls are reflective to microwaves, and are capable of withstanding temperatures typically reached in microwave ovens. Additionally, the walls are designed to withstand steam accumulation and heat transfer, and, in some embodiments, are non-stick, and thus can be easily cleaned. For example, in some embodiments, standard commercially-available microwave oven paint is used to coat the interior walls of first cavity 501 and second cavity 502.

In some embodiments, first cavity 501 and second cavity 502 are constructed from a single cavity. In such embodiments, a single cavity is formed, and barrier 503 is placed inside the single cavity, thereby forming first cavity 501 and second cavity 502. In other embodiments, first cavity 501 and second cavity 502 are formed separately, and barrier 503 is formed by adjacent walls of first cavity 501 and second cavity 502. In such embodiments, the walls perpendicular to barrier 503 are segmented, with the segments slideable over each other such that the walls can collapse and expand. For example, in one embodiment, in the first position depicted in FIG. 5A, the walls of first cavity 501 perpendicular to barrier 503 include two segments that mostly overlap each other, and the walls of second cavity 502 perpendicular to barrier 503 include two segments that are mostly non-overlapping. As barrier 503 shifts to the second position depicted in FIG. 5B, the walls of first cavity 501 extend to become mostly non-overlapping, and the walls of second cavity 502 collapse to become mostly overlapping.

As described above, in some embodiments, barrier 503 is comprised, at least in part, of adjacent walls of the first cavity and the second cavity. Generally, barrier 503 is comprised of materials similar to those comprising the walls of first cavity 501 and second cavity 502. Importantly, in any embodiment, barrier 503 electromagnetically isolates first cavity 501 from second cavity 502 with respect to microwaves. Thus, in some embodiments, barrier 503 includes painted metal, such as steel or aluminum. Additionally, in some embodiments, barrier 503 forms a seal that at least partially thermally isolates first cavity 501 from second cavity 502. For example, in one embodiment, barrier 503 includes a vacuum cavity within a metallic panel. While it is generally understood that absolute thermal isolation is impossible, such an embodiment provides sufficient isolation for the temperatures and time scales experienced in a microwave oven that thermal leaching has a negligible effect on objects being heated in the separate cavities.

In some embodiments where first cavity 501 and second cavity 502 are formed from a single cavity, barrier 503 is supported by notches protruding from the walls of the single cavity. In the same or other embodiments, barrier 503 is held in place magnetically. For example, in some such embodiments, barrier 503 includes permanent magnets disposed within barrier 503 along the outside edges of barrier 503, such as by gluing the magnets to the wall with heat-resistant and/or heat-cured glue. The walls of the single cavity include corresponding magnets outside the cavity positioned on the wall where barrier 503 is to be secured. In one embodiment, the magnets of barrier 503 and the single cavity are aligned north-to-south. In another embodiment, the magnets are aligned north-to-north or south-to-south. In such an embodiment, it is also occasionally beneficial to include sets of magnets mounted to the wall and spaced apart such that the magnets in barrier 503 fit between the wall magnets.

Door 504 is comprised, on a side of door 504 facing towards first cavity 501 and second cavity 502, materials similar to those forming the cavities, and on a side of door 504 facing away from the cavities, any of a variety of materials, such as stainless steel, aluminum, or plastic, to name a few. Generally, door 504 is comprised of materials commonly used in manufacturing microwave oven doors. Door 504 includes viewing port 504*a*, which is generally formed of a glass or microwave-safe plastic material having metal strands running through the glass or plastic to reflect microwaves. Door 504 is, in various embodiments, secured by a detent or an electromagnet. For example, in the depicted embodiment, door 504 is electromagnetically latched closed. A permanent magnet is installed in door 504, and a corresponding electromagnet and weak permanent magnet are installed in the body of microwave oven 500. When a user presses the "OPEN" button on control panel 505, the direction of the current running through the electromagnet is switched momentarily (for up to 2-3 seconds in some cases), reversing the direction of the magnetic field generated by the electromagnet. The reverse magnetic field is stronger than the force generated by the magnetic fields of the permanent magnets in door 504 and the body, and forces door 504 open.

Control panel 505 is, generally, an interface that allows the user to interact with processors and memory that control operation of microwave oven 500. In some embodiments, control panel 505 is a graphical user interface displayed on a touchscreen. In other embodiments, control panel 505 includes one or more push buttons. In yet other embodiments, control panel 505 includes permanent markings on or over a touchscreen.

The hardware processors and memory store instructions for operating microwave oven 500. In various embodiments, those instructions include identifying which cavity is desired for use, identifying a power level either desired or necessary, identifying an amount of time needed for cooking, and delivering power to the appropriate magnetron. In some embodiments, some or all of these steps are automated. For example, in one embodiment, microwave oven 500 includes diodes corresponding to each cavity. The processors use the diodes to determine which cavity contains an object or objects to be heated and powers the corresponding magnetrons accordingly.

Housing 506 is comprised of any of a variety of materials typical for microwave ovens, and includes various metals and/or plastics. At least a portion of housing 506 is metal to provide grounding for the electronics that power microwave oven 500. Generally, housing 506 is sturdy enough to provide structural support for one or more of the magnetrons, power transformers, first cavity 501, and second cavity 502.

Figure 6A:
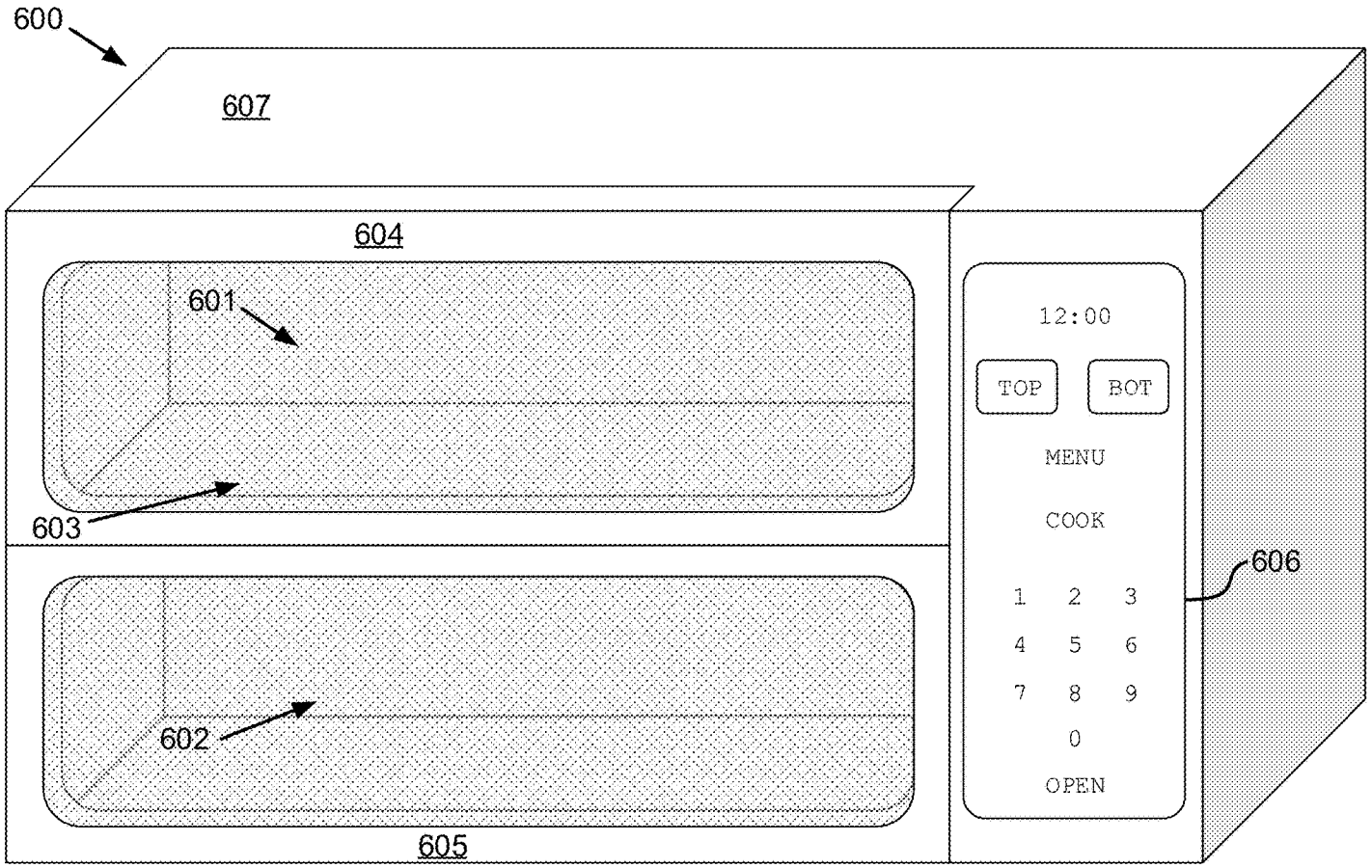
FIGS. 6A-B depict an embodiment of a microwave oven similar to that described above with regard to FIGS. 5A-B, however, including two doors instead of one.
Figure 6B:
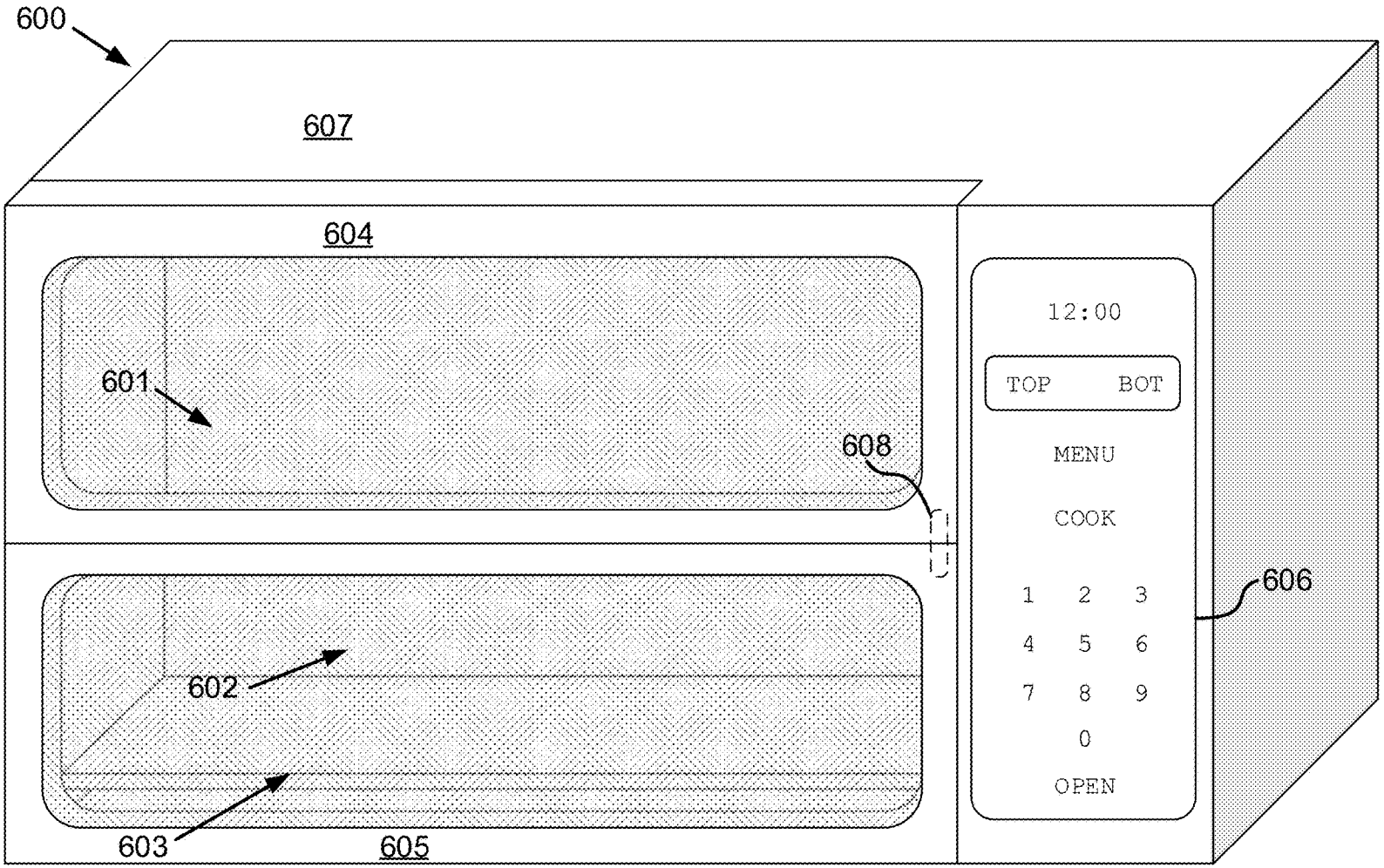

FIGS. 6A-B depict an embodiment of a microwave oven similar to that described above with regard to FIGS. 5A-B, however including two doors instead of one. Microwave oven 600 includes first cavity 601, second cavity 602, barrier 603, first door 604, second door 605, control panel 606, and housing 607. Although not shown, microwave 600 also includes power electronics, two magnetrons, and a hardware controller having hardware processors and hardware memory.

In some embodiments, the hardware controller determines which cavity to provide power to based on which door was most recently opened or closed. In such embodiments, each door includes a switch that is closed when the door is closed and opened when the door opens. One such switch is a magnetic switch, such as that described above with regard to FIGS. 5A-B. A user selects which cavity to use, the top or the bottom, by pressing the "TOP" or "BOT" button, or both, on control panel 606. The user then presses the "OPEN" button, which switches the current in the appropriate electromagnets and opens the appropriate door. The controller includes instructions to queue the cavity for powering when the controller receives the instructions to open the door or doors. The user inputs a desired cook time and presses "COOK," and the controller directs power to the appropriate magnetron.

Barrier 603 is depicted in FIG. 6A in a first position, where cavity 601 and cavity 602 are roughly equal in size, and in FIG. 6B in a second position, where cavity 601 is larger than cavity 602. In some embodiments, latch 608 is disposed between door 604 and door 605 as barrier 603 is in the second position, preventing individual operation of either door. Additionally, in some embodiments, as barrier 603 is in the second position, the controller stores instructions to open both doors when the "OPEN" button is pressed.

In some embodiments, door 604 and door 605 open in the same direction, such as to the right, downwards, or upwards. In embodiments where both doors open downwards or upwards, it is occasionally beneficial to lock door 604 closed as barrier 603 is in the second position. In other embodiments, door 604 and door 605 open in opposite directions. For example, in one such embodiment, door 604 opens downwards and door 605 opens upwards. In some cases of such an embodiment, door 604 and/or door 605 include pneumatic, hydraulic, or spring-loaded articulators that support the doors in the open position and prevent the doors form slamming closed. In another embodiment where the doors open in opposite directions, door 604 opens downwards and door 605 opens upwards.

As used herein, the direction of opening, such as "right," "left," "up," or "down" refers to a direction of rotation about a pivot point on the door. The pivot point is, in many cases, closest to the directionally-indicated edge of the door. For example, a door that opens to the right pivots at it's right-most edge, with the left edge swinging around the pivot point in a clockwise manner towards the right.

Figure 7A:
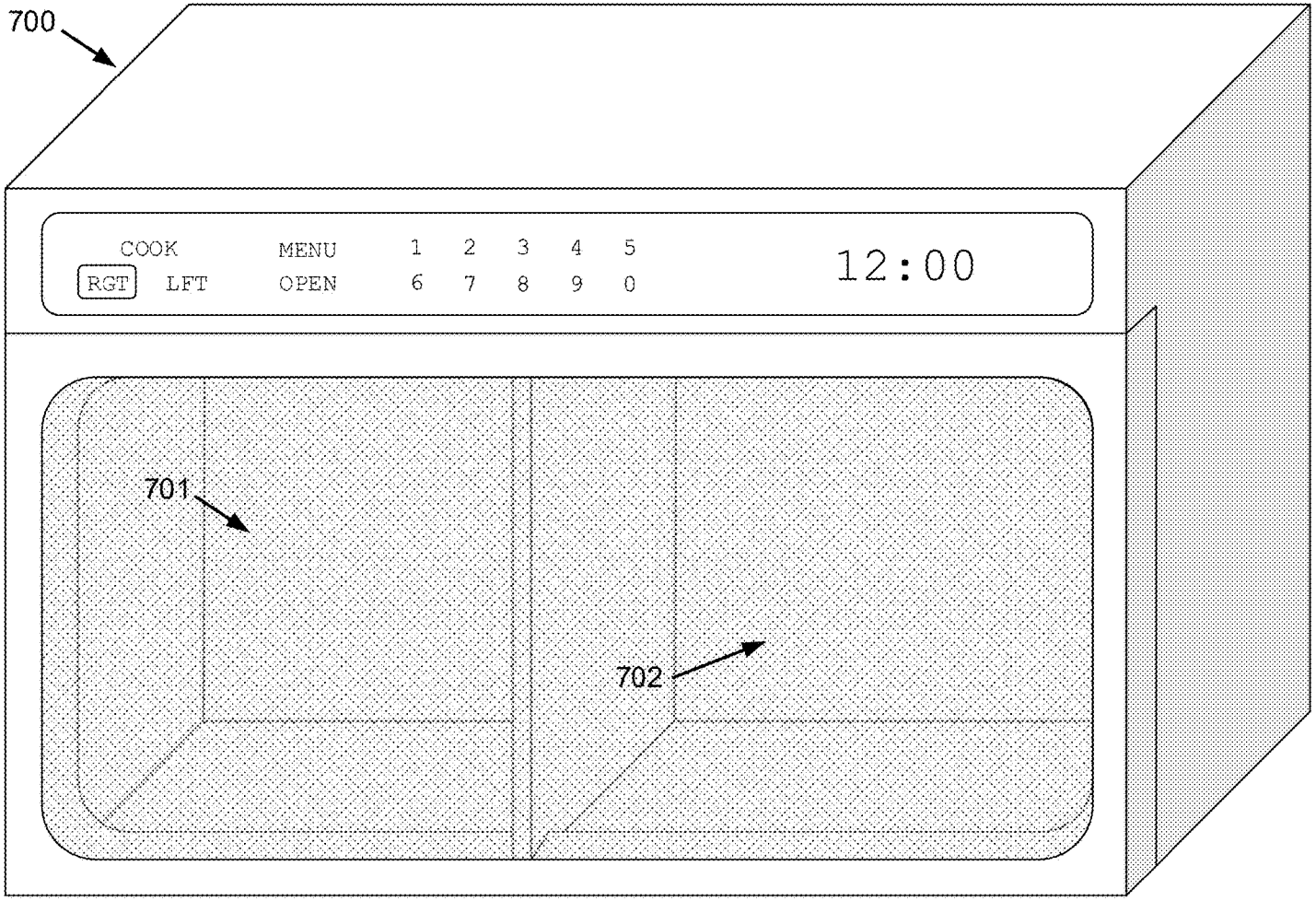
FIGS. 7A-B depict an embodiment of a microwave oven having side-by-side cavities.
Figure 7B:
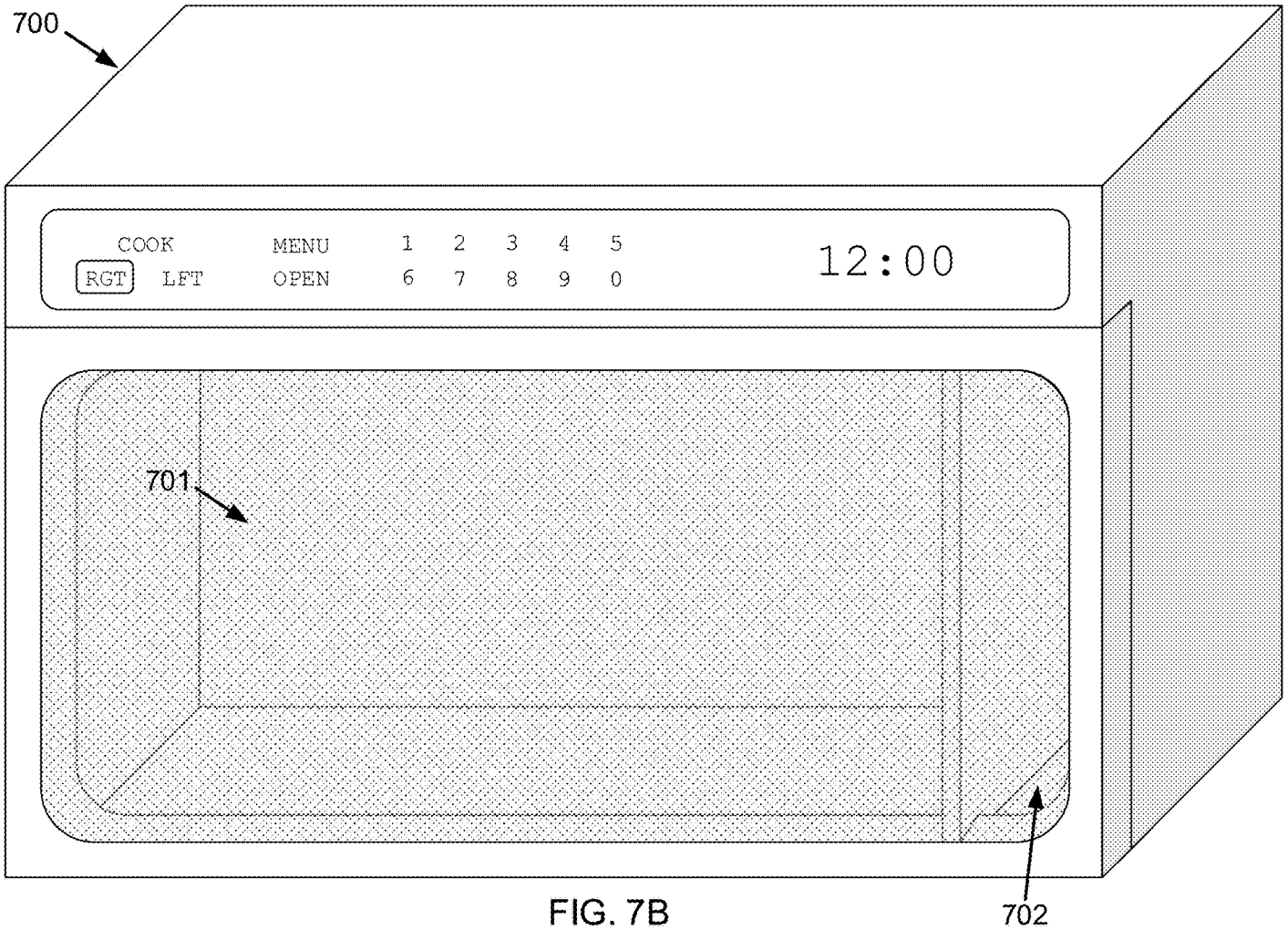

FIGS. 7A-B depict an embodiment of a microwave oven having side-by-side cavities. Microwave oven 700 includes laterally adjacent cooking cavities 701 and 702. In many other respects, microwave oven 700 is similar to ovens 500 and 600 described above.

Figure 8A:
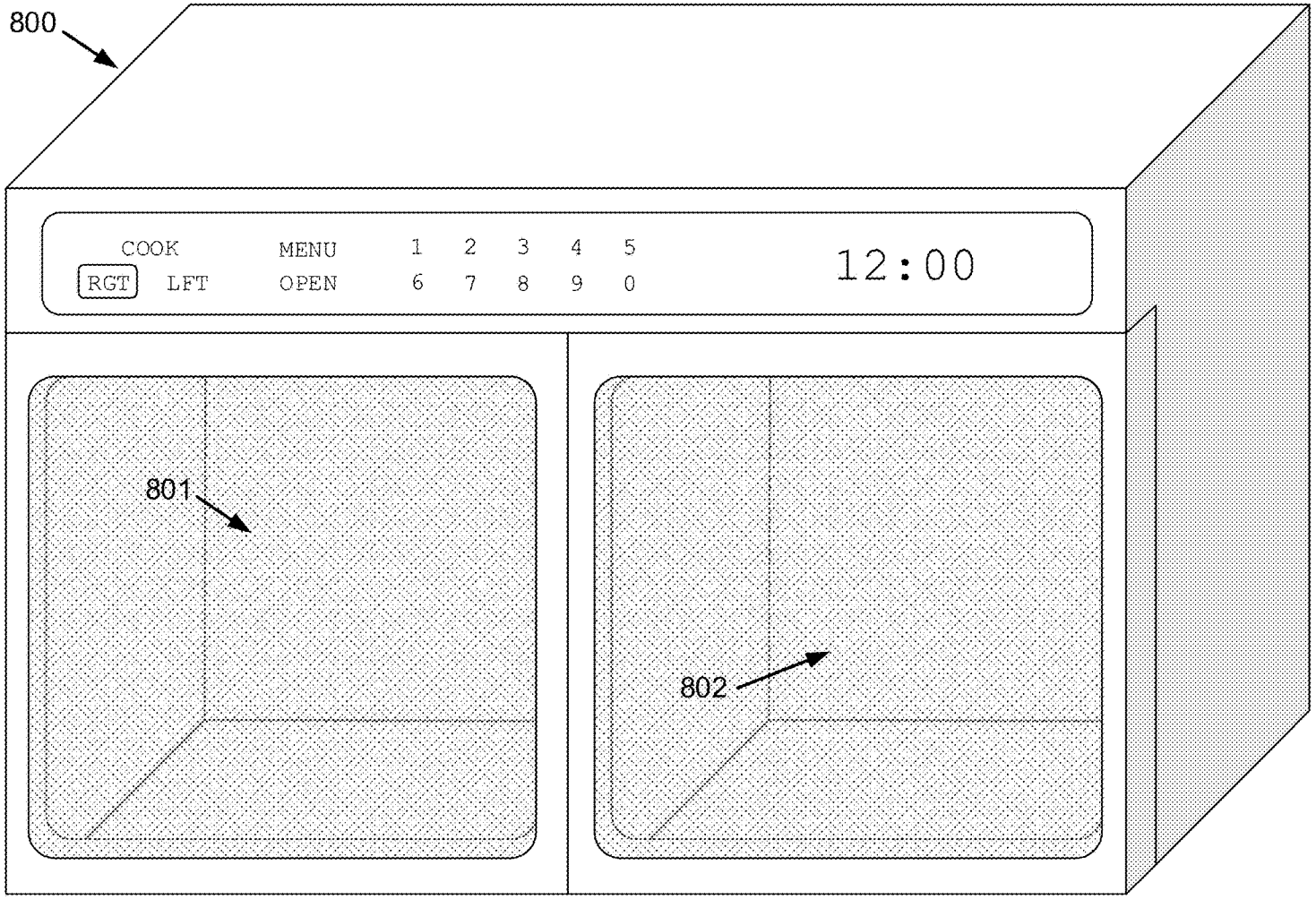
FIGS. 8A-B depict a second embodiment of a microwave oven having side-by-side cavities.
Figure 8B:
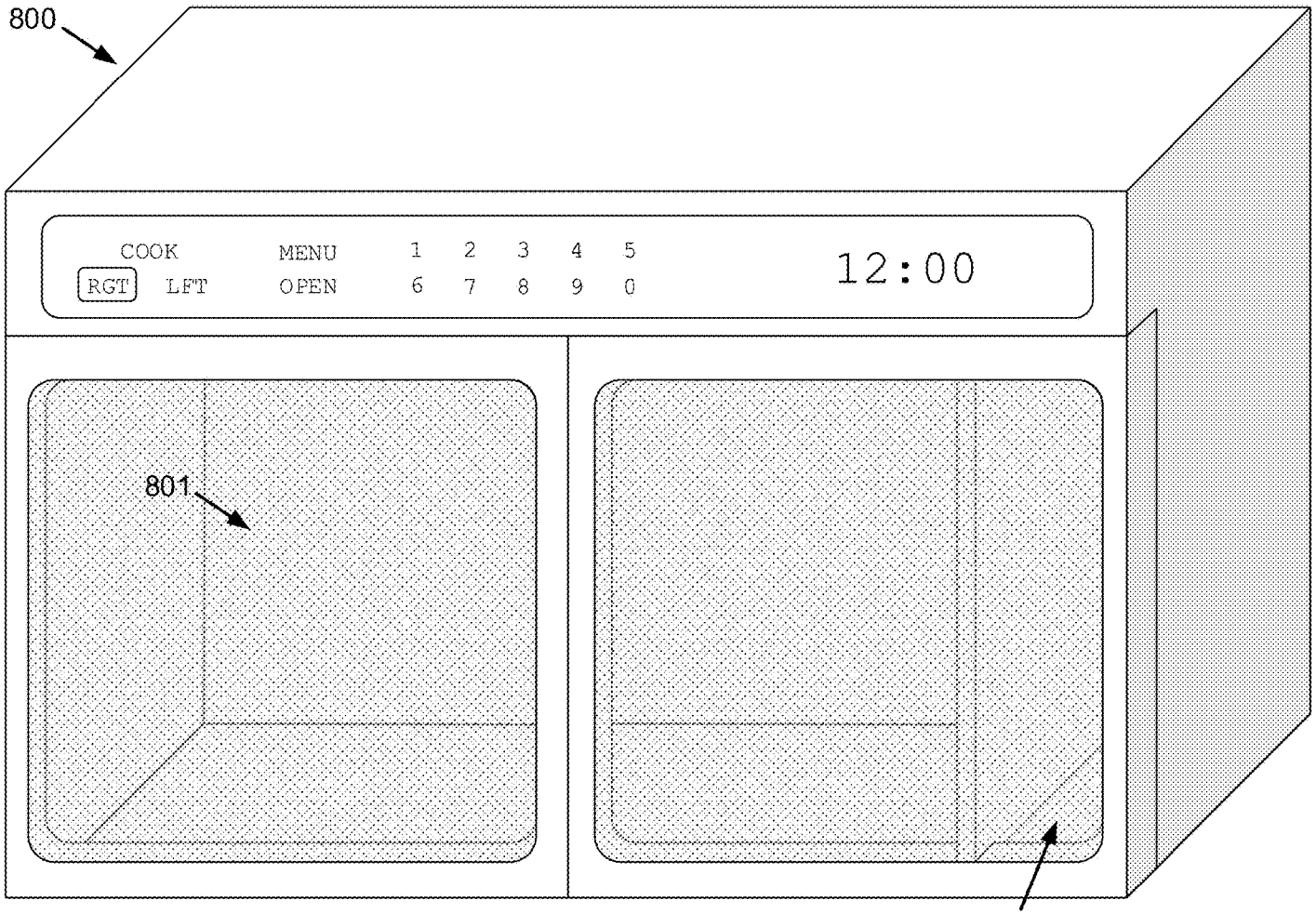

FIGS. 8A-B depict a second embodiment of a microwave oven having side-by-side cavities. Microwave oven 800, however, includes two doors for accessing cooking cavities 801 and 802. In many other respects, microwave oven 800 is similar to ovens 500, 600 and 700 described above.

Figure 9A:
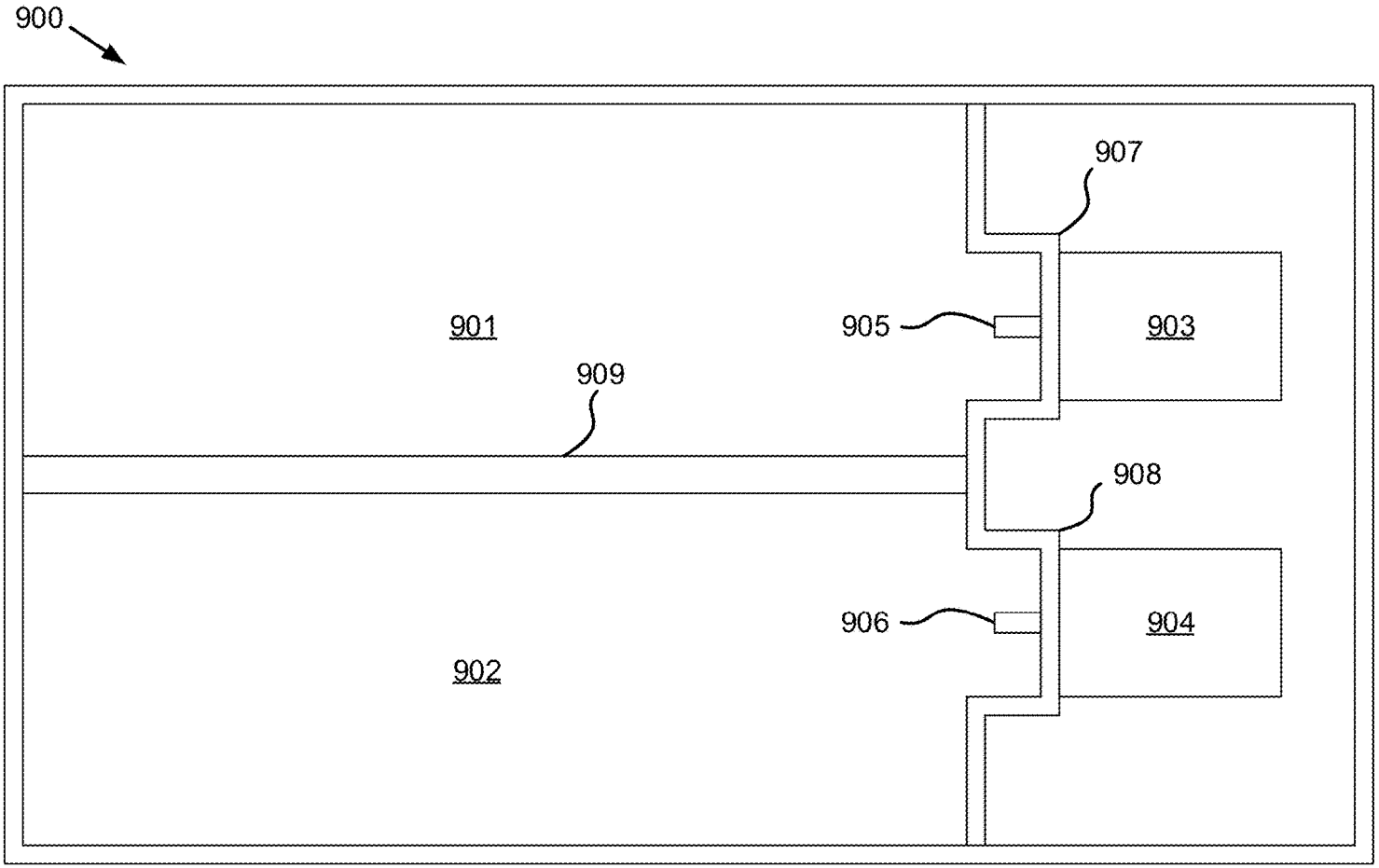
FIGS. 9A-B depict a cut-away side view of a microwave oven according to the claimed invention, including selected internal components.
Figure 9B:
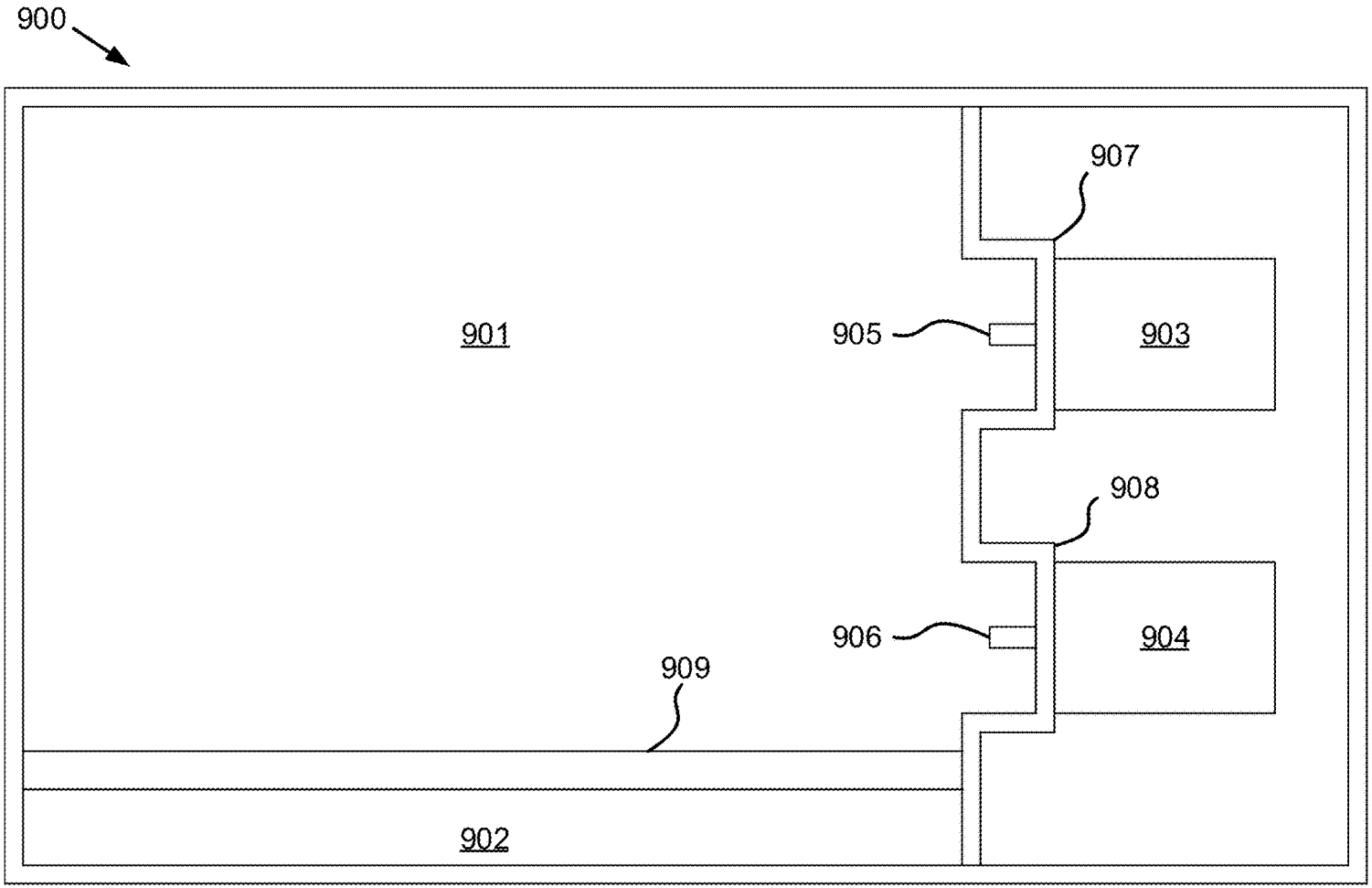

FIGS. 9A-B depict a cut-away side view of a microwave oven according to the claimed invention, including selected internal components. As depicted, microwave oven 900 includes first cavity 901, second cavity 902, first magnetron 903, second magnetron 904, first antenna 905, second antenna 906, first waveguide 907, second waveguide 908, and barrier 909. FIG. 9A depicts barrier 909 in a first position such that first cavity 901 and second cavity 902 are approximately equal in size. FIG. 9B depicts barrier 907 in a second position such that first cavity 901 is larger than second cavity 902. As barrier 909 is in the first position, microwaves generated by first magnetron 903 and emitted by first antenna 905 are directed by first waveguide 907 to first cavity 901, and microwaves generated by second magnetron 904 and emitted by second antenna 906 are directed by second waveguide 908 to second cavity 902. In the second position, microwaves generated by both magnetrons are directed by both waveguides to first cavity 901. In this manner, microwave oven 900 is convertible from two single-magnetron ovens to one dual-magnetron oven.

The magnetrons, antennas, and waveguides are, in various embodiments, similar or identical to those commonly used in existing microwaves. However, in some embodiments, the waveguides are excluded, such that the antennas extend into the cavities. In such embodiments, the antennas are shielded from the cavities by a microwave-transparent housing to protect the antennas from exposure to food, liquid, and/or steam that all too often finds its way to the walls of microwave oven cooking cavities.

Figure 10A:
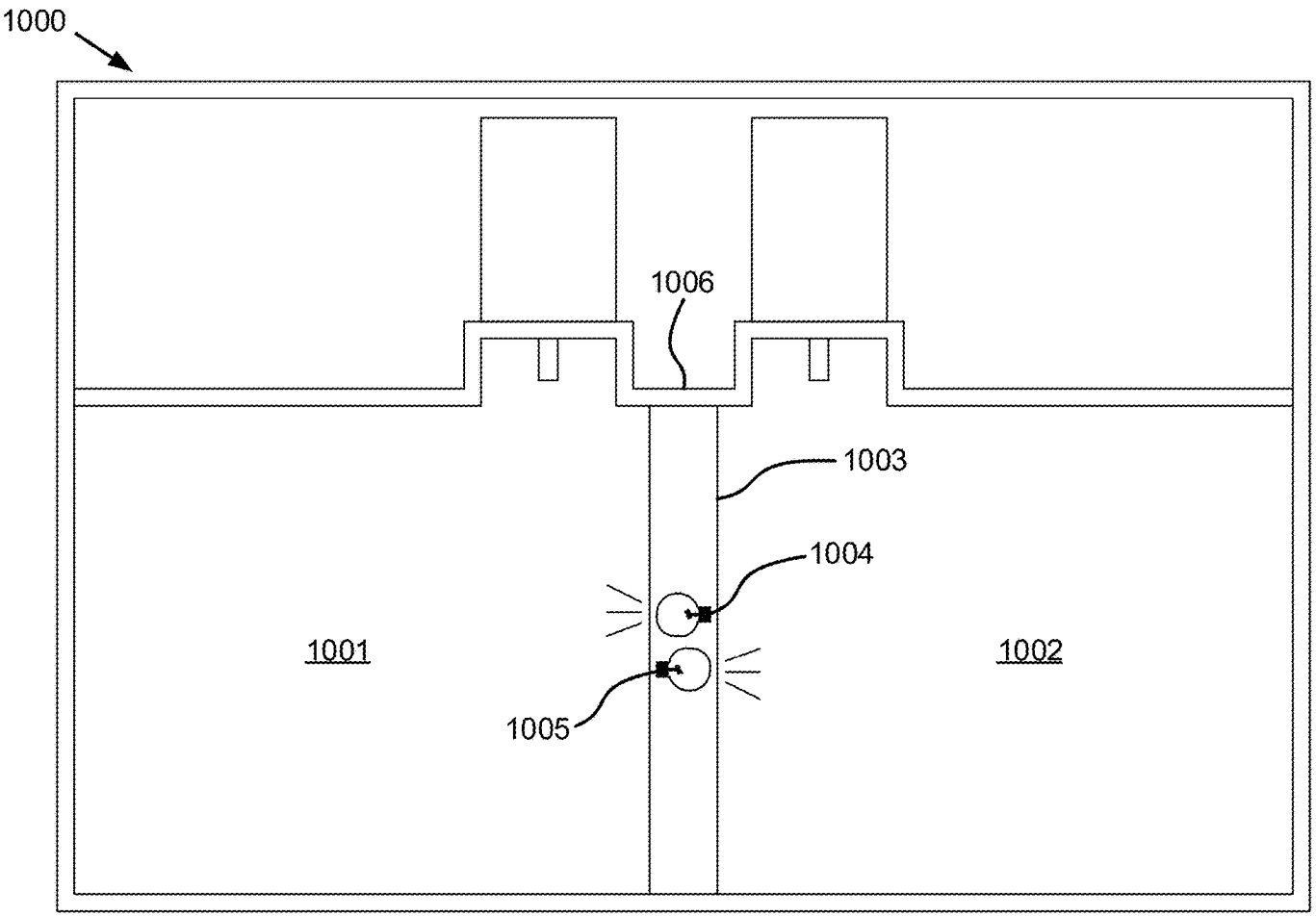
FIGS. 10A-B depict a cut-away side view of a microwave oven having a cavity barrier with lights disposed in the cavity barrier.
Figure 10B:
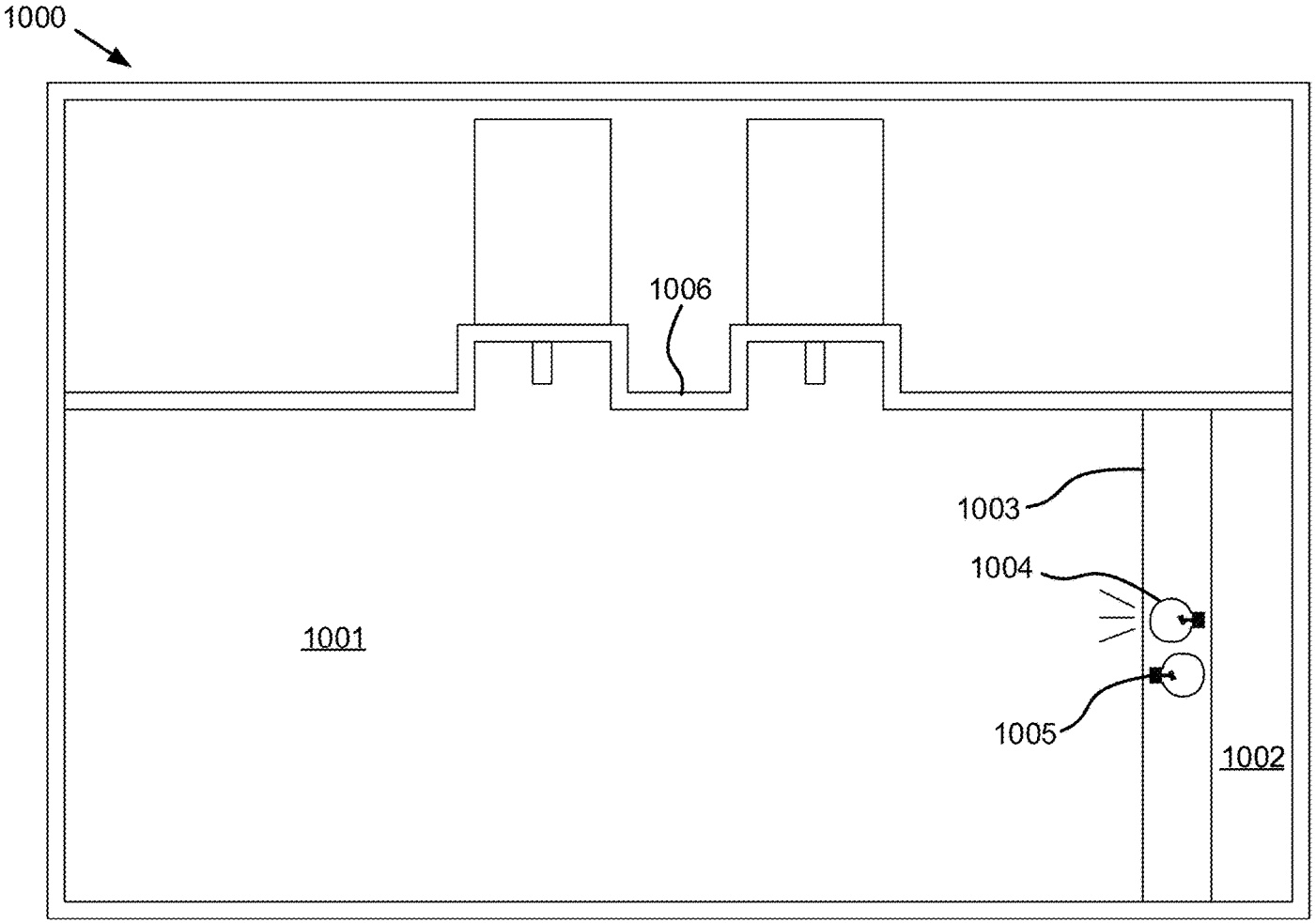

FIGS. 10A-B depict a cut-away side view of a microwave oven having a cavity barrier with lights disposed in the cavity barrier. Microwave oven 1000 includes first cavity 1001, second cavity 1002, barrier 1003, first light 1004, and second light 1005. The lights are any of a variety of light sources, including incandescent lights, LEDs, and fluorescent lights. The lights are disposed inside barrier 1003, and are powered via wires running from a controller, through grooves in wall 1006, and into barrier 1003 (such grooves are depicted and described in more detail regarding FIGS. 14-15. Barrier 1003 includes shielding between the lights and the cavities to shield the lights from microwaves. The shielding is at least partially transparent to visible light and approximately opaque to microwaves, such as is commonly used in current microwave ovens. In FIG. 10B, barrier 1003 is in a second position (similar to that described with regard to other figures above). In the second position, only light 1004 is powered, and provides light to first cavity 1001. The controller stores instructions that, when executed, prevent current from flowing to second light 1005 as barrier 1003 is in the second position.

Figure 11B:
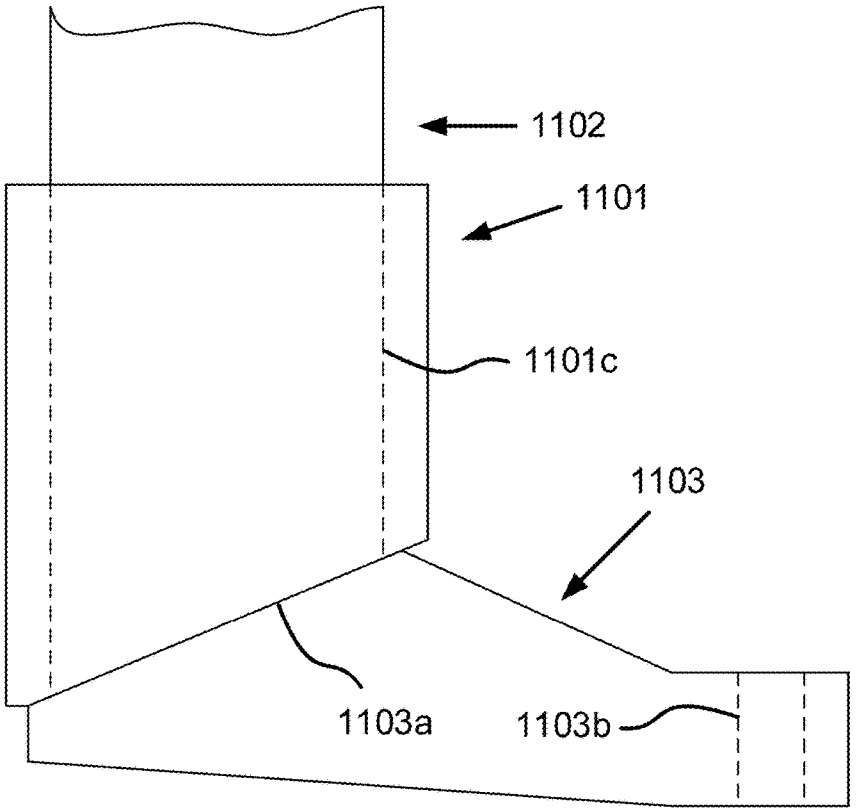
FIGS. 11A-B depict portions of one embodiment of an oscillating mechanism for use with a microwave oven according to the claimed invention.
Figure 11A:
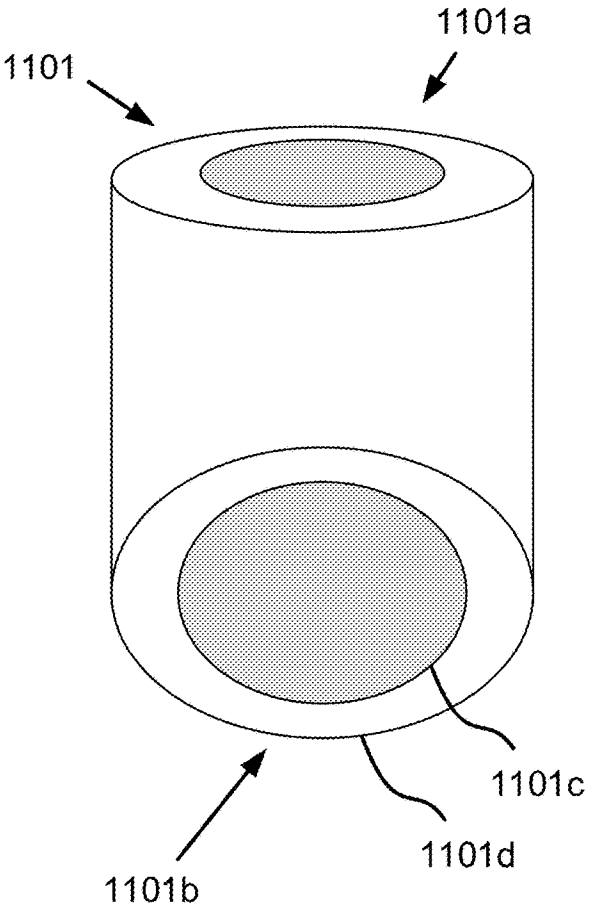

FIGS. 11A-B depict portions of one embodiment of an oscillating mechanism for use with a microwave oven according to the claimed invention. FIG. 11A depicts collar 1101. Collar 1101 has flat end 1101*a*, sloped end 1101*b*, channel 1101*c*, and lip 1101*d*. FIG. 11B depicts shaft 1102 passing through channel 1101*c* in collar 1101 and foot 1103. Shaft 1102 is fixedly coupled to foot 1103 such that, as shaft 1102 is rotated, foot 1103 rotates. Foot 1103 includes lip 1103*a* and mounting channel 1103*b*. Lip 1103*a* presses against lip 1101*d*. Because end 1101*b* is sloped collar 1101 forces shaft 1102 and foot 1103 down. An external force, applied, for example, by a spring, forces shaft 1102 and foot 1103 back up as they continue to rotate. Mounting channel 1103*b* allows a bolt to couple foot 1103 to an object to be oscillated by the rotation of foot 1103.

Figure 12:
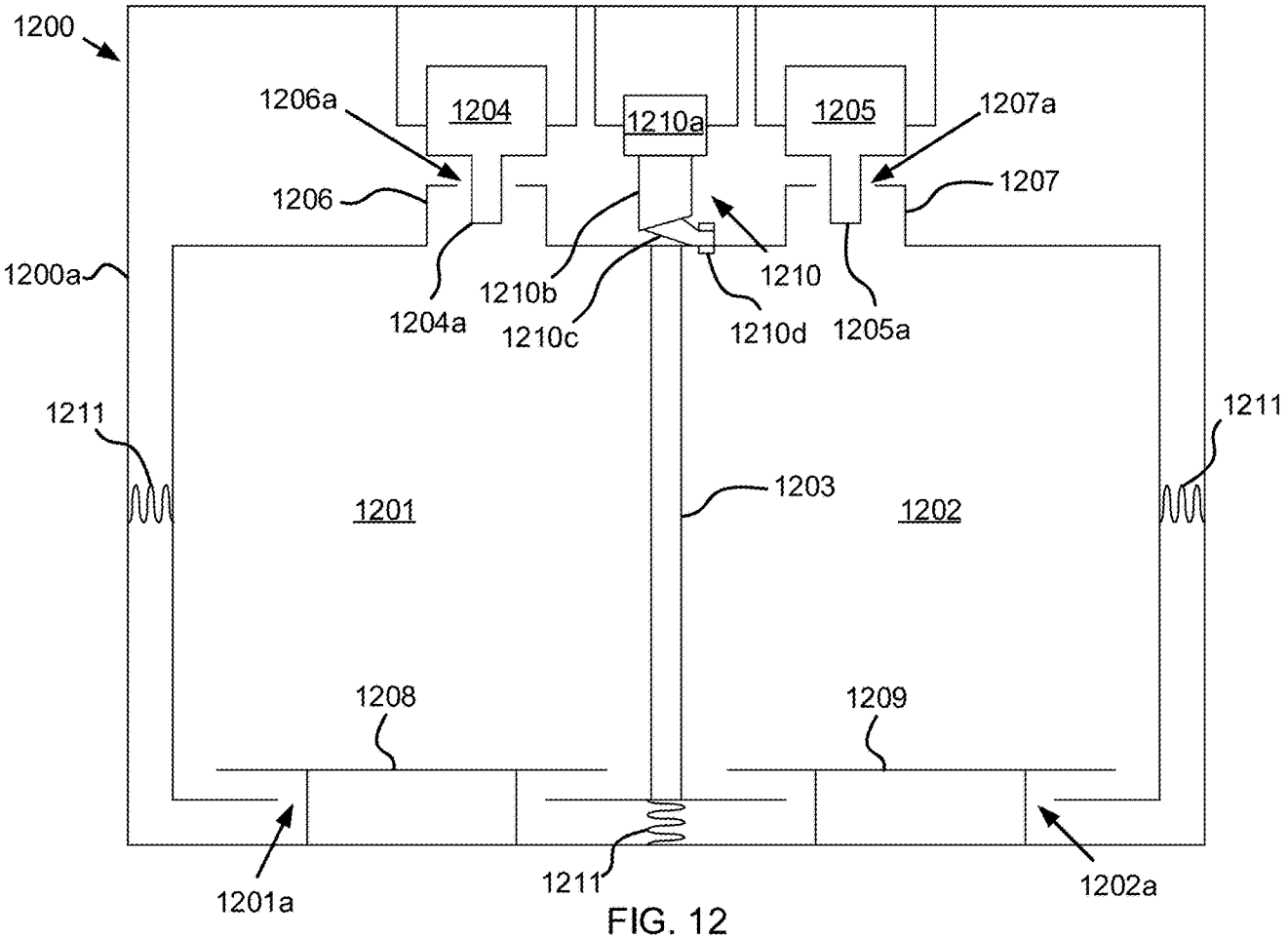
FIG. 12 depicts one embodiment of an oscillating cooking cavity according to the claimed invention.

FIG. 12 depicts one embodiment of an oscillating cooking cavity according to the claimed invention. Microwave oven 1200 includes first cavity 1201, second cavity 1202, barrier 1203, magnetrons 1204, 1205, waveguides 1206, 1207, support plates 1208, 1209, oscillator 1210, and springs 1211. The cavities and magnetrons are similar to those already described above. The waveguides include spaced openings 1206*a*, 1207*a* around antennas 1204*a*, 1205*a*, respectively. Cavities 1201, 1202 includes spaced openings 1201*a*, 1202*a* around the support plates. As depicted, the magnetrons and support plates are fixed to housing 1200*a*. The spaced openings allow the cavities to oscillate with respect to the fixed components of oven 1200 extending into the cavities and waveguides. In some embodiments, the waveguides are fixed to the magnetrons, and the cavities include additional spaced openings around the waveguides.

Oscillator 1210 includes motor 1210*a*, collar 1210*b*, foot 1210*c*, and mounting bolt 1210*d*. Motor 1210*a* is fixedly coupled to housing 1200*a*, and rotates a shaft fixedly coupled to foot 1210*c* (the shaft similar to shaft 1102 described above). Foot 1210*c* is rotatably coupled to, in the depicted embodiment, a wall of cavity 1202 by bolt 1210*d*. As shown, bolt 1210*d* is off-center between the two cavities, which enables oscillation back-and-forth and left-to right. As motor 1210*a* rotates footing 1210*c*, collar 1210*b* and the off-center coupling of foot 1210*c* to the cavities causes the cavities to oscillate with respect to housing 1200*a*, and those components fixed to it, up-and-down, left-to-right, and back-and forth.

In some embodiments, oscillator 1210 rotates in a continuous fashion. In other embodiments, a controller for microwave 1200 (similar to those described above) includes instructions for powering the motor that varies the speed and direction of the oscillation, either based on a desired cooking setting, time, and/or level, or during cooking to account for variability of zones of constructive interference within the microwave.

Figure 13:
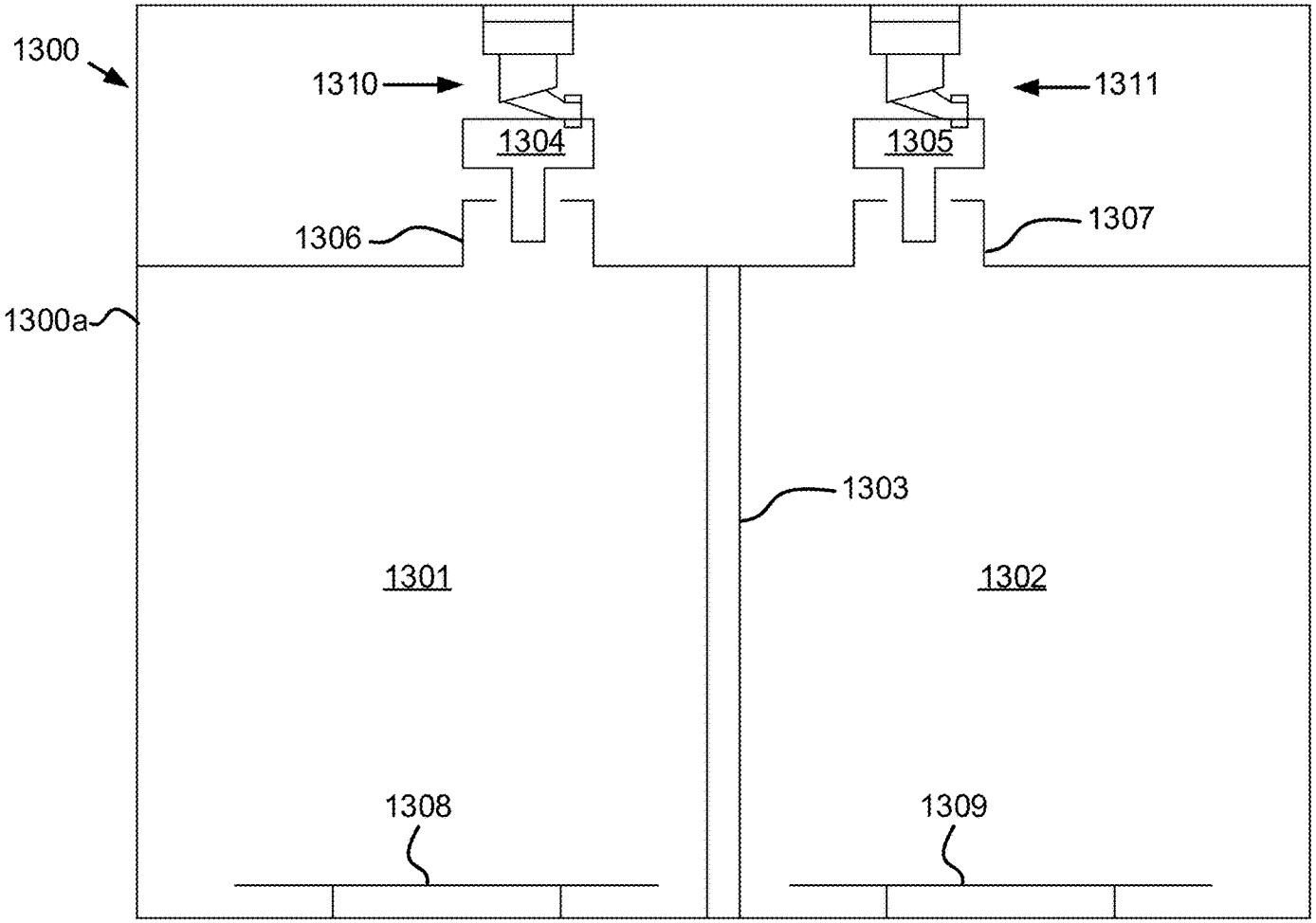
FIG. 13 depicts an embodiment of a microwave oven having oscillating magnetrons.

FIG. 13 depicts an embodiment of a microwave oven having oscillating magnetrons. Microwave oven 1300 includes first cavity 1301, second cavity 1302, barrier 1303, magnetrons 1304, 1305, waveguides 1306, 1307, support plates 1308, 1309, and oscillators 1310, 1311. The cavities, support plates, waveguides, and oscillators are fixed to housing 1300*a*. The oscillators move the magnetrons to vary the positioning of zones of constructive interference in the cavities.

Figure 14:
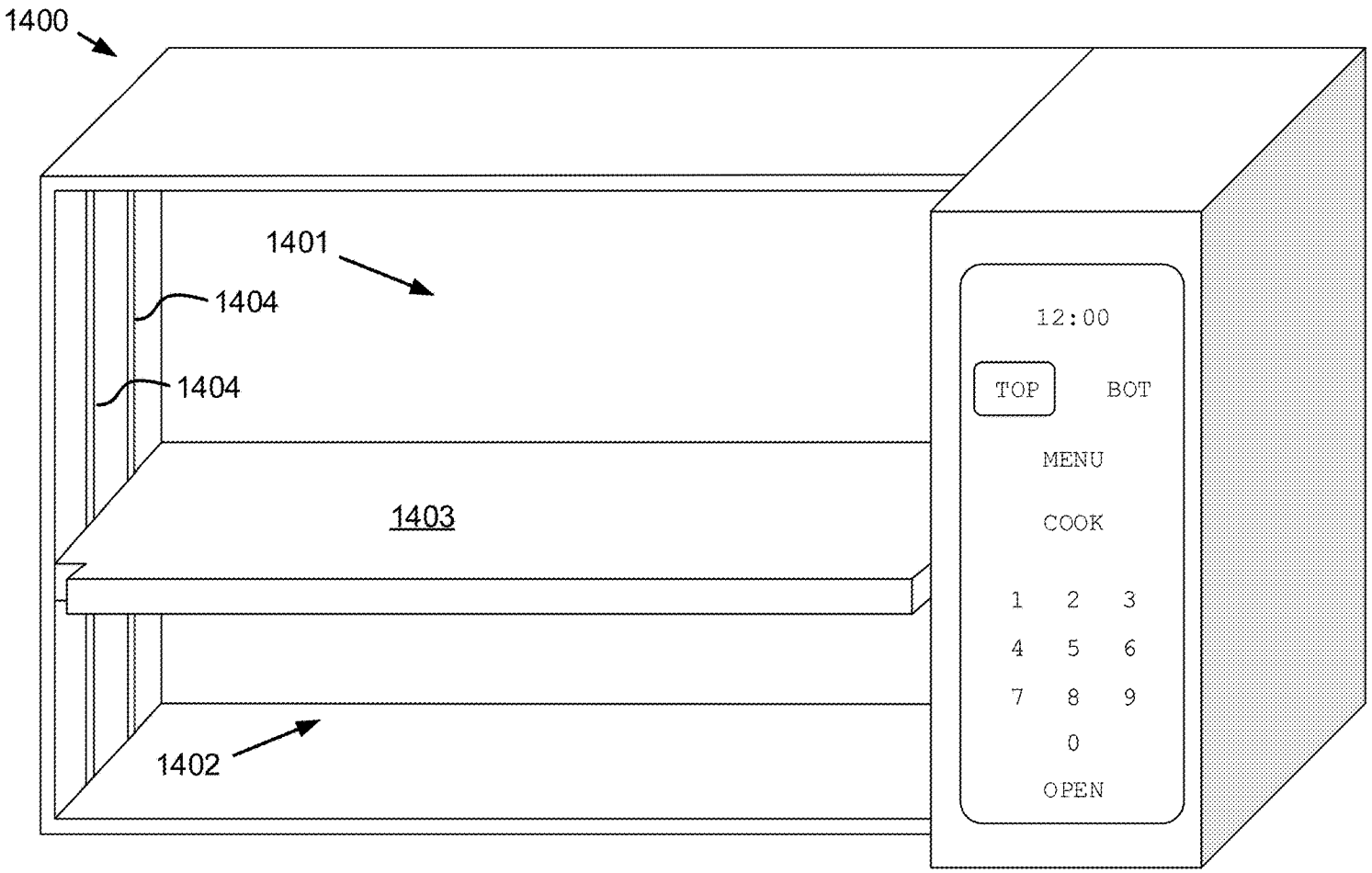
FIG. 14 depicts an embodiment of a microwave oven according to the claimed invention with the door removed.

FIG. 14 depicts an embodiment of a microwave oven according to the claimed invention with the door removed. Microwave oven 1400 includes first cavity 1401, second cavity 1402, barrier 1403, and slots 1404. The barrier includes tabs that extend into the slots. The slots guide the barrier up and down as it moves between first and second positions, and fixes the barrier within the oven.

Figure 15:
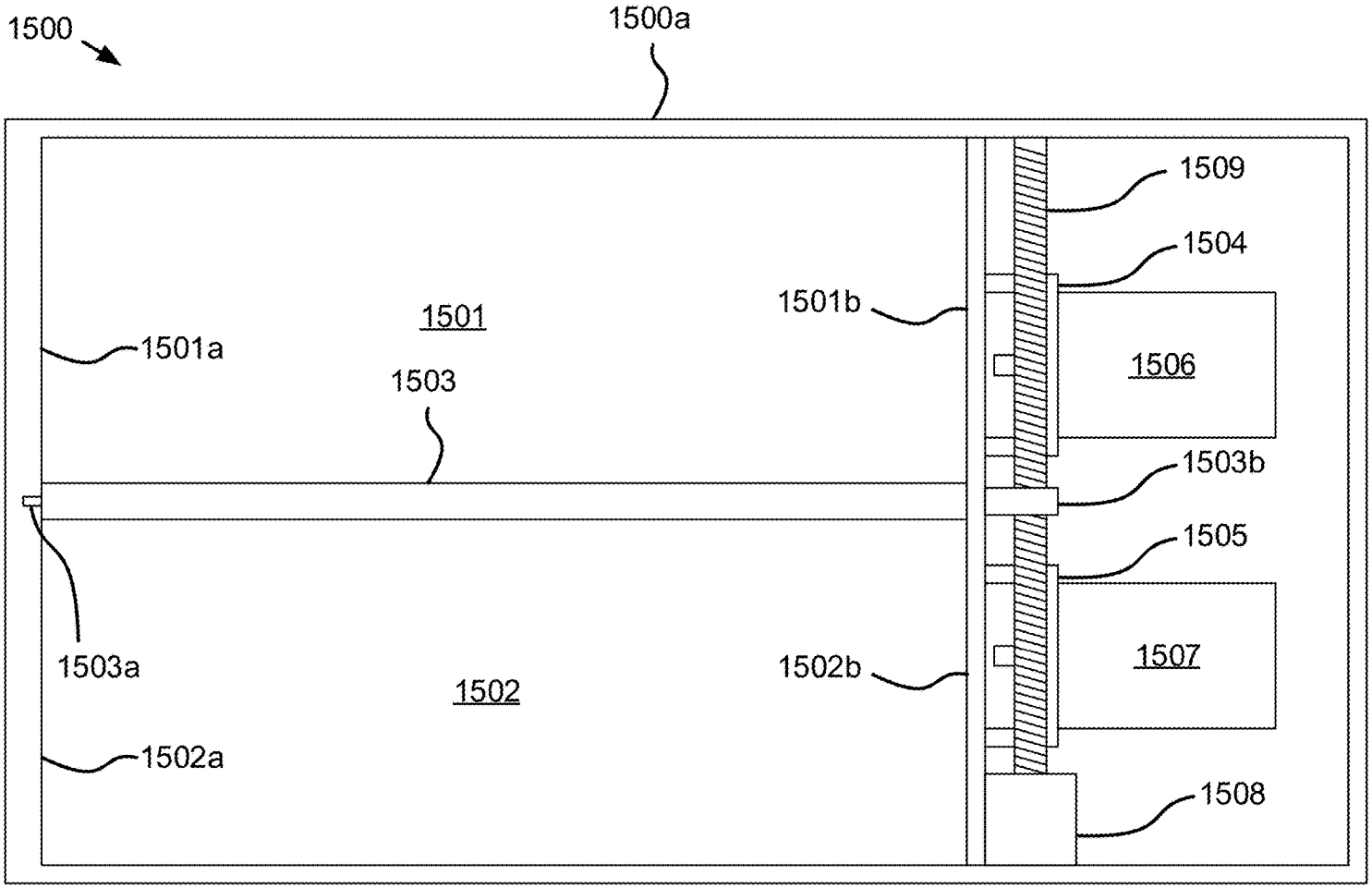
FIG. 15 depicts a cutout side view of a microwave oven having a motorized barrier, according to the claimed invention, including selected components.

FIG. 15 depicts a cutout side view of a microwave oven having a motorized barrier, according to the claimed invention, including selected components. Microwave oven 1500 includes first cavity 1501, second cavity 1502, barrier 1503, waveguides 1504, 1505, magnetrons 1506, 1507, motor 1508, and transmission 1509. The barrier includes tab 1503*a* that extends into slots in cavity wall 1501*a*, 1502*a* (such as those depicted in FIG. 14), and threaded-slot tab 1503*b* that extends into slots in cavity walls 1501*b*, 1502*b*. Transmission 1509 is threaded, and extends through tab 1503*b*, which has threading corresponding to the transmission. The motor rotates the transmission, and the threads cause the barrier to move up or down depending on the direction of the rotation.

Figure 16:
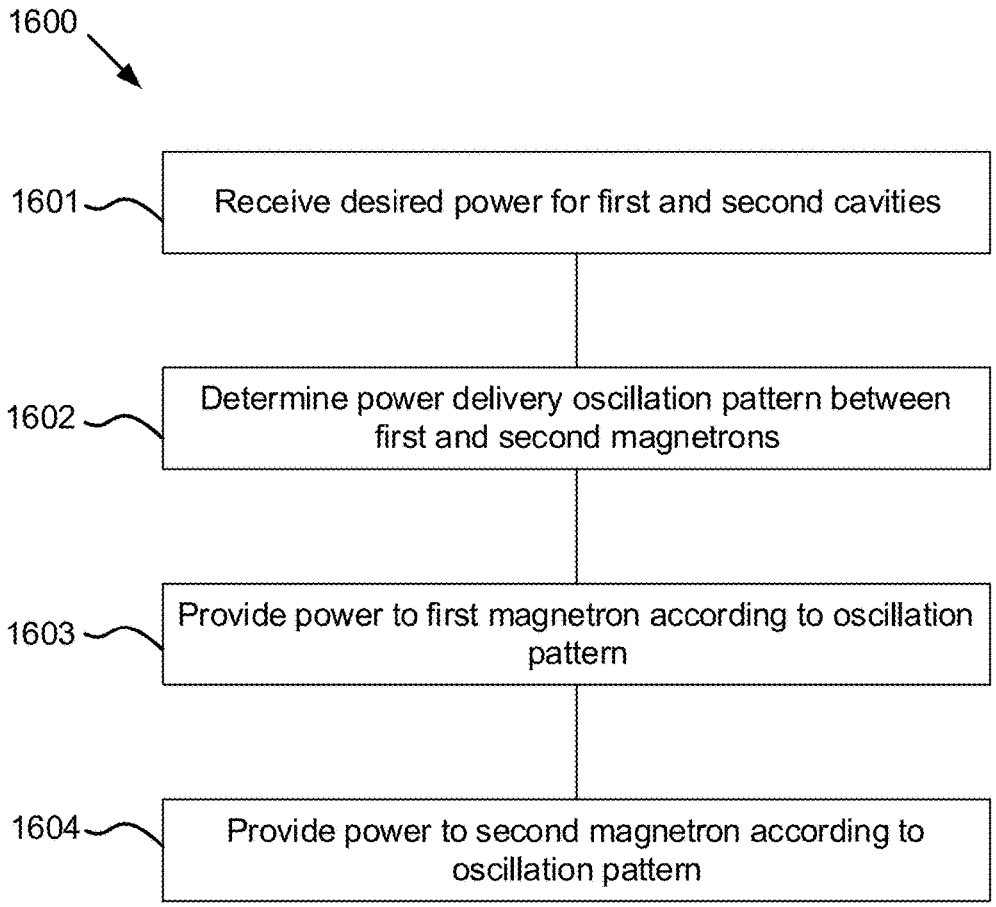
FIG. 16 depicts one embodiment of a method of providing power to a dual-magnetron microwave oven according to the claimed invention.

FIG. 16 depicts one embodiment of a method of providing power to a dual-magnetron microwave oven according to the claimed invention. Method 1600 includes, at block 1601, receiving desired power settings for a first and/or second cooking cavity from a user via, for example, a control pad coupled to a hardware controller (such as those described above); at block 1602, determining a power delivery oscillation pattern between first and second magnetrons corresponding to the first and second cavities; and, at blocks 1603, 1604, providing power to the first and/or second magnetron based on the oscillation pattern.

The invention claimed is:

1. A double-cavity microwave oven, comprising:

a first and a second cooking cavity, wherein the first cavity is electromagnetically isolated from the second cavity;

a moveable barrier disposed between the first and the second cavity, wherein, as the barrier moves, the size of the first cavity relative to the second cavity changes;

a first and a second magnetron;

a first and a second waveguide corresponding to the first and the second magnetron, respectively, wherein, as the barrier is in a first position, the first waveguide directs microwaves from the first magnetron to the first cavity and the second waveguide directs microwaves from the second magnetron to the second cavity, and wherein, as the barrier is in a second position, the first and the second waveguide direct microwaves from the first and the second magnetron to the first cavity.

2. The microwave oven of claim 1, further comprising a door, wherein the door provides access by a user to the first and the second cooking cavity.

3. The microwave oven of claim 2, wherein the door thermally, electromagnetically, or thermally and electromagnetically segregates the first cavity from the second cavity.

4. The microwave oven of claim 1, further comprising:

a first door corresponding to the first cavity;

a second door corresponding to the second cavity, wherein the first door is adjacent to the second door, and wherein the first and the second door each form an electromagnetic seal with the barrier.

5. The microwave oven of claim 4, wherein the first door is disposed above the second door, and wherein the first and the second door open in the same direction;

wherein the first and the second door are side-by-side, and wherein the first and the second door open in the same direction;

wherein the first door is disposed above the second door, wherein the first door opens up and the second door opens down; or wherein the first and the second door are side-by-side, wherein the first and the second door open away from each other, and wherein the first door opens to the left and the second door opens to the right.

6. The microwave oven of claim 4, wherein the second door locks and becomes non-operable as the barrier is in the second position.

7. The microwave oven of claim 1, wherein the barrier thermally segregates the first cavity from the second cavity.

8. The microwave oven of claim 1, wherein the barrier is moveable in a first direction and fixed in a second direction perpendicular to the first direction such that the barrier is non-removeable from the microwave oven.

9. The microwave oven of claim 1, wherein the barrier comprises:

one or more lights; and microwave shielding between the lights and the first magnetron, the second magnetron, or both, wherein the shielding is at least partially transparent to visible light.

10. The microwave oven of claim 9, wherein the one or more lights includes a first light facing the first cavity and a second light facing the second cavity.

11. The microwave oven of claim 1, wherein the barrier is motorized.

12. The microwave oven of claim 1, wherein at least one of the first or the second cavity oscillates relative to at least one of the first or the second waveguide such that a first path length from the at least one waveguide to a first wall of the at least one cavity and a second path length from the at least one waveguide to a second wall of the at least one cavity varies with the oscillation.

13. The microwave oven of claim 12, further comprising a stationary support plate disposed in the at least one cavity such that a third path length from the at least one waveguide to the support surface is constant with the oscillation.

14. The microwave oven of claim 1, wherein at least one of the first or the second waveguide oscillates relative to at least one of the first or the second cavity such that a first path length from the at least one waveguide to a first wall of the at least one cavity and a second path length from the at least one waveguide to a second wall of the at least one cavity varies with the oscillation.

15. The microwave oven of claim 1, further comprising a support plate, wherein the support plate oscillates along three dimensional axes such that a first path length from the first waveguide, the second waveguide, or both, to the support plate varies with the oscillation.

16. The microwave oven of claim 1, wherein at least one of the first and the second cavities comprises at least one flexible wall that oscillates such that a first path length from the first waveguide, the second waveguide, or both, to the flexible wall varies with the oscillation.

17. The microwave oven of claim 1, further comprising:

one or more hardware processors; and hardware memory, the hardware memory storing instructions that, when executed by the hardware processors, operate the first magnetron, the second magnetron, or both.

18. The microwave oven of claim 1, wherein operating the first and the second magnetron comprises oscillating power delivery from a single power input between the first and the second magnetron.

19. The microwave oven of claim 18, wherein the processors are coupled to one user input device for both cavities, and wherein the processors know which magnetron to power based on which door was opened or a reflectance pattern of microwaves generated by the first magnetron, the second magnetron, or both.

20. The microwave oven of claim 1, further comprising at least one door magnetically latched to a body of the microwave oven, wherein the magnetic latch includes a permanent magnet disposed in the door, and an electro magnet and permanent magnet disposed in the body corresponding to the permanent magnet in the door.

* * * * *